US010639899B2

(12) United States Patent
Shimazaki et al.

(10) Patent No.: US 10,639,899 B2
(45) Date of Patent: May 5, 2020

(54) LIQUID EJECTING APPARATUS AND LIQUID EJECTING APPARATUS MAINTENANCE METHOD

(71) Applicant: SEIKO EPSON CORPORATION, Tokyo (JP)

(72) Inventors: Jun Shimazaki, Shiojiri (JP); Shigenori Nakagawa, Tatsuno (JP); Yoichi Kurogochi, Shiojiri (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/294,669

(22) Filed: Mar. 6, 2019

(65) Prior Publication Data

US 2019/0275799 A1 Sep. 12, 2019

(30) Foreign Application Priority Data

Mar. 7, 2018 (JP) ..... 2018-040463

(51) Int. Cl.
*B41J 2/165* (2006.01)
*B41J 29/17* (2006.01)

(52) U.S. Cl.
CPC ..... *B41J 2/16535* (2013.01); *B41J 2/16508* (2013.01); *B41J 2/16517* (2013.01); *B41J 2/16523* (2013.01); *B41J 2/16526* (2013.01); *B41J 2/16532* (2013.01); *B41J 2/16538* (2013.01); *B41J 2/16541* (2013.01); *B41J 29/17* (2013.01); *B41J 2002/1655* (2013.01)

(58) Field of Classification Search
CPC .... B41J 2/16535; B41J 29/17; B41J 2/16532; B41J 2/16526; B41J 2/16538; B41J 2/16523; B41J 2/16541; B41J 2/16517; B41J 2/16508; B41J 2002/1655; B41J 29/13; B41J 29/02; B41J 2/175
USPC ..... 347/33
See application file for complete search history.

(56) References Cited

U.S. PATENT DOCUMENTS 5,907,335 A 5/1999 Johnson et al.
6,151,044 A * 11/2000 Gaasch ..... B41J 2/16544 347/33

(Continued)

FOREIGN PATENT DOCUMENTS

JP H10-146984 A 6/1998
JP 2006-240235 A 9/2006

(Continued)

*Primary Examiner* — Huan H Tran
*Assistant Examiner* — Alexander D Shenderov
(74) *Attorney, Agent, or Firm* — Workman Nydegger

(57) ABSTRACT

A liquid ejecting apparatus includes a medium support portion that has a medium support surface for supporting a medium, a liquid ejecting unit that ejects liquid onto the medium supported on the medium support surface through a plurality of nozzles arranged in a nozzle surface, a first cleaning member that wipes the nozzle surface by moving relative to the liquid ejecting unit in a direction along the nozzle surface in a first maintenance operation of discharging the liquid through the nozzles for maintenance of the liquid ejecting unit, and a second cleaning member that removes foreign matters which have adhered to the nozzle surface by moving relative to the liquid ejecting unit in the direction along the nozzle surface in a second maintenance operation of removing the foreign matters.

15 Claims, 16 Drawing Sheets

(56) References Cited

U.S. PATENT DOCUMENTS 6,409,303 B1 * 6/2002 Anderson ..... B41J 2/16538 347/28
2001/0043251 A1 * 11/2001 Beachnau Hood .. B41J 2/16538 347/33
2003/0058299 A1 * 3/2003 Endo ..... B41J 2/16579 347/23
2004/0012651 A1 * 1/2004 Agarwal ..... B41J 2/16544 347/33
2004/0263602 A1 * 12/2004 Nakashima ..... B41J 2/16585 347/104
2005/0062796 A1 * 3/2005 Mott ..... B41J 2/16535 347/33
2005/0093919 A1 * 5/2005 Takatsuka ..... B41J 2/16523 347/30
2005/0122371 A1 * 6/2005 Aliaga ..... B41J 2/16517 347/22
2008/0150999 A1 * 6/2008 Cook ..... B41J 2/16544 347/33
2014/0152740 A1 6/2014 Yoshino et al.
2015/0336387 A1 11/2015 Miyazaki

FOREIGN PATENT DOCUMENTS

JP 2009-137210 A 6/2009
JP 2010-030185 A 2/2010
JP 2010-120177 A 6/2010
JP 2011-110831 A 6/2011
JP 2011-161652 A 8/2011
JP 2011-201308 A 10/2011
JP 2014-108594 A 6/2014
JP 2015-020407 A 2/2015
JP 2015-168192 A 9/2015
JP 2016-000516 A 1/2016
JP 2016-002708 A 1/2016
JP 2016-190501 A 11/2016
JP 2017-080918 A 5/2017

* cited by examiner

LIQUID EJECTING APPARATUS AND LIQUID EJECTING APPARATUS MAINTENANCE METHOD

BACKGROUND

1. Technical Field

The present invention relates to a liquid ejecting apparatus such as a printer, and a liquid ejecting apparatus maintenance method.

2. Related Art

As examples of liquid ejecting apparatuses, there are ink jet printers that eject liquid through nozzles formed in nozzle surfaces for printing. Among these printers, for example, there is a printer that includes a wiper as an example of a first cleaning member for wiping a nozzle surface and performs wiping processing of wiping the nozzle surface by the wiper, as disclosed in JP-A-2010-30185.

The printer performs, by the same wiper, the wiping processing that is performed when foreign matters have adhered to the nozzle surface and the wiping processing that is performed in combination with ink suction processing. In the wiping processing that is performed when the foreign matters have adhered to the nozzle surface, the foreign matters scrapped from the nozzle surface adhere to the wiper in some cases. When the wiping processing that is performed in combination with the suction processing is performed by the wiper to which the foreign matters have adhered, there is a risk that the foreign matters enter the nozzles and deterioration in a surface state of the nozzle surface is hastened to make ejection of the liquid through the nozzles unstable.

The above-described problem is not limited to occurring in the printer including the wiper for wiping the nozzle surface and substantially commonly occurs in liquid ejecting apparatuses including the first cleaning members for wiping the nozzle surfaces.

SUMMARY

A liquid ejecting apparatus according to an aspect of the invention includes a medium support portion that has a medium support surface for supporting a medium, a liquid ejecting unit that ejects liquid onto the medium supported on the medium support surface through a plurality of nozzles arranged in a nozzle surface, a first cleaning member that wipes the nozzle surface by moving relative to the liquid ejecting unit in a direction along the nozzle surface in a first maintenance operation of discharging the liquid through the nozzles for maintenance of the liquid ejecting unit, and a second cleaning member that removes foreign matters which have adhered to the nozzle surface by moving relative to the liquid ejecting unit in the direction along the nozzle surface in a second maintenance operation of removing the foreign matters.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of a liquid ejecting apparatus and a liquid ejecting apparatus maintenance method will be described with reference to the drawings. The liquid ejecting apparatus is, for example, an ink jet printer that ejects liquid such as ink onto a medium such as a fabric for printing.

Figure 1:
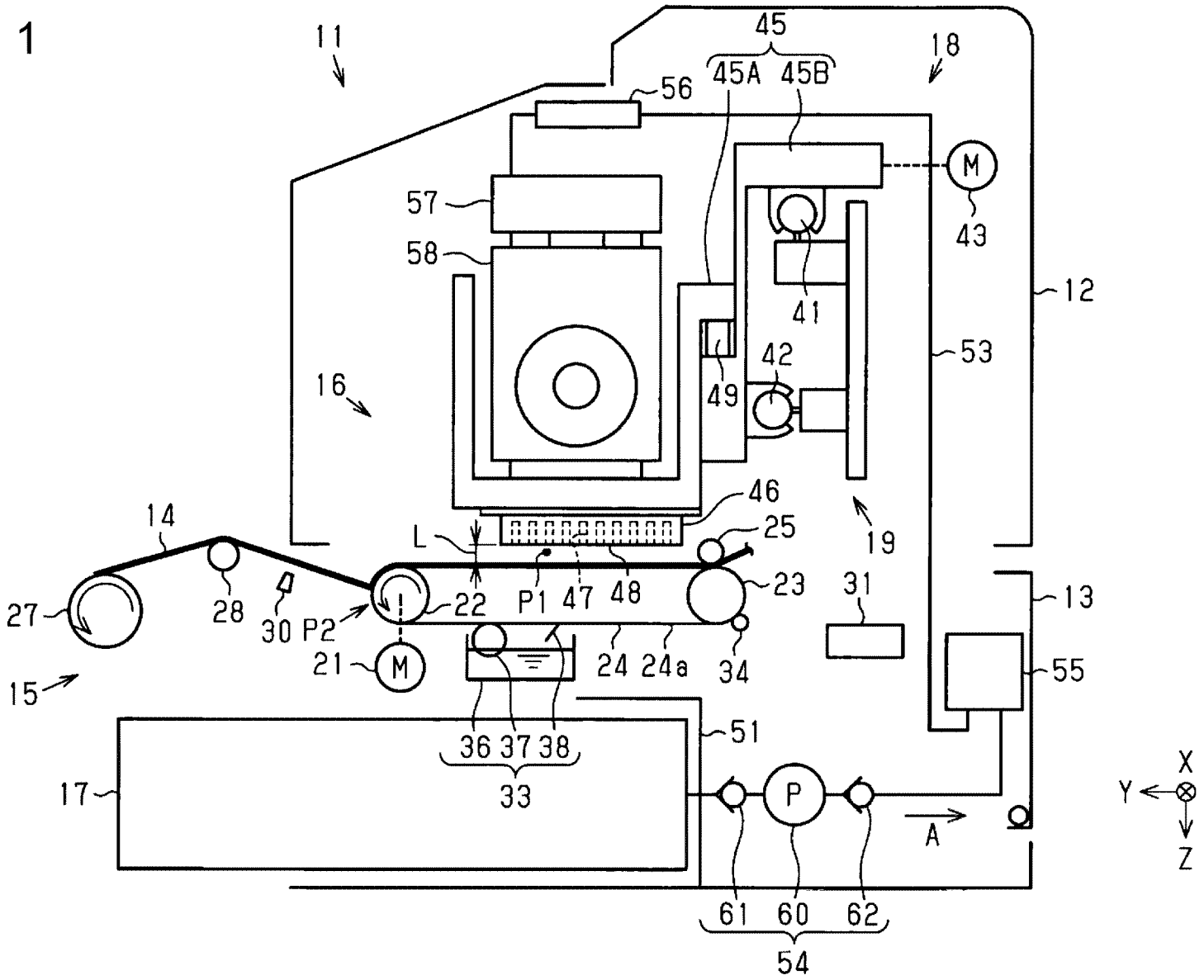
FIG. 1 is a schematic view illustrating the schematic configuration of a liquid ejecting apparatus according to a first embodiment.

As illustrated in FIG. 1, a liquid ejecting apparatus 11 includes a housing 12 and a cover 13 mounted on the housing 12 in an openable/closable manner. The liquid ejecting apparatus 11 includes a transportation unit 15 that transports a medium 14, a liquid ejecting unit 16 that ejects liquid for printing on the medium 14, supply mechanisms 18 that supply the liquid accommodated in liquid accommodation portions 17 to the liquid ejecting unit 16, and a movement mechanism 19 that moves the liquid ejecting unit 16.

In the drawings, a Z axis indicates a gravity force direction, and an X axis and a Y axis indicate directions along a surface intersecting with the Z axis while the liquid ejecting apparatus 11 is placed on a horizontal surface. The X axis, the Y axis, and the Z axis are preferably orthogonal to one another, and the X axis and the Y axis are along the horizontal surface. An X-axis direction in the embodiment is a width direction of the medium 14 and is a direction in which the liquid ejecting unit 16 moves. A Y-axis direction in the embodiment is a direction in which the medium 14 is transported at a print position P1 at which printing is performed on the medium 14. A Z-axis direction in the embodiment is a direction in which the liquid ejecting unit 16 ejects liquid. In the following description, the X-axis direction is also referred to as a scanning direction X, the Y-axis direction is also referred to as a transportation direction Y, and the Z-axis direction is also referred to as a vertical direction Z.

Next, an embodiment of the transportation unit 15 will be described.

The transportation unit 15 includes a transportation motor 21, a driving pulley 22 that rotates by driving of the transportation motor 21, and a driven pulley 23 that is rotatable about an axial line being parallel to an axial line of the driving pulley 22. The transportation unit 15 includes an annular transportation belt 24 that is wound around the driving pulley 22 and the driven pulley 23 and a pressure roller 25 that presses the medium 14 against the transportation belt 24. The pressure roller 25 presses the medium 14 and the transportation belt 24 against the driven pulley 23 so as to interpose the medium 14 between the pressure roller 25 and the driven pulley 23.

The inner circumferential surface of the transportation belt 24 makes contact with the driving pulley 22 and the driven pulley 23. The outer circumferential surface of the transportation belt 24 is a medium support surface 24*a* supporting the medium 14. The transportation belt 24 in the embodiment is an adhesive belt in which an adhesive has been applied to the medium support surface 24*a* and allows the medium 14 to adhere thereto in a releasable manner to support the medium 14. The transportation belt 24 revolves around the driving pulley 22 and the driven pulley 23 with the driving of the transportation motor 21 and transports the medium 14 in the transportation direction Y in a state of supporting it on the medium support surface 24*a*.

The transportation unit 15 includes a winding portion 27 that winding up the medium 14 on which printing has been performed and a driven roller 28 that is located between the winding portion 27 and the transportation belt 24. The medium 14 transported by the transportation belt 24 is released from the transportation belt 24, and then, is wound up by the winding portion 27 after passing through the driven roller 28.

The liquid ejecting unit 11 includes a release sensor 30 that detects the medium 14 released from the transportation belt 24 and a controller 31 that collectively controls driving of respective mechanisms in the liquid ejecting apparatus 11, such as the transportation unit 15 and the liquid ejecting unit 16. The release sensor 30 is provided at a position along a transportation path of the medium 14 between the transportation belt 24 and the driven roller 28. The release sensor 30 is, for example, an optical sensor including a light emitting portion and a light receiving portion and detects a distance to the medium 14 by emitting light from a direction intersecting with the surface of the medium 14. The controller 31 detects a release position P2 at which the medium 14 is released from the transportation belt 24 based on a detection result by the release sensor 30. The controller 31 controls driving of the winding portion 27 such that the release position P2 is located at the lower side, in the vertical direction Z, relative to the medium 14 located at the print position P1.

The liquid ejecting apparatus 11 includes a washing unit 33 for washing the transportation belt 24 with a washing solution and an absorption roller 34 capable of absorbing the washing solution. That is to say, the liquid ejecting apparatus 11 includes the washing unit 33 as an example of a cleaning mechanism that cleans the transportation belt 24 as an example of a medium support portion.

The absorption roller 34 is a roller formed by using, for example, a fabric capable of absorbing liquid for a portion making contact with the transportation belt 24. The absorption roller 34 pinches the transportation belt 24 with the driven pulley 23 and assists removal of the washing solution and the liquid which have adhered to the transportation belt 24. The washing unit 33 and the absorption roller 34 are provided so as to be movable between positions illustrated in FIG. 1 at which they make contact with the transportation belt 24 by driving of a washing motor (not illustrated) and positions (not illustrated) at which they are separated from the transportation belt 24.

The washing unit 33 includes a washing solution accommodation portion 36 for accommodating therein the washing solution, a washing brush 37 for washing the transportation belt 24 while making contact with the transportation belt 24, and a washing wiper 38 for removing the washing solution and the liquid which have adhered to the transportation belt 24. The washing solution is liquid or water containing a detergent composition such as a surfactant, for example. The washing unit 33 may include the plurality of washing wipers 38.

Next, embodiments of the liquid ejecting unit 16 and the movement mechanism 19 will be described.

The movement mechanism 19 includes a first guide shaft 41 and a second guide shaft 42 provided so as to extend in the scanning direction X, and a carriage motor 43.

The liquid ejecting unit 16 includes a carriage 45 that can reciprocate in the scanning direction X while being guided by the first guide shaft 41 and the second guide shaft 42, and at least one liquid ejecting head 46 that is mounted on a lower end portion of the carriage 45. Four liquid ejecting heads 46 are mounted on the carriage 45 in the embodiment. The carriage motor 43 is a motor for moving the carriage 45.

Each liquid ejecting head 46 has a nozzle surface 48 in which a plurality of nozzles 47 is formed. The liquid ejecting head 46 is provided such that the nozzle surface 48 faces the transportation belt 24 or the medium 14 supported on the transportation belt 24 in the vertical direction Z. The liquid ejecting head 46 ejects the liquid onto the medium 14 supported on the medium support surface 24*a* of the transportation belt 24 through the plurality of nozzles 47 while moving in the scanning direction X intersecting with the transportation direction Y for printing on the medium 14.

The carriage 45 includes a carriage main body 45A on which the liquid ejecting heads 46 are mounted, a carriage base 45B that is guided by the first guide shaft 41 and the second guide shaft 42, and an adjustment mechanism 49 that adjusts a position of the carriage main body 45A relative to the carriage base 45B. The adjustment mechanism 49 is formed by, for example, a cam or the like. The adjustment mechanism 49 moves the carriage main body 45A in a sliding manner relative to the carriage base 45B in the vertical direction Z. The adjustment mechanism 49 changes a distance L between the nozzle surfaces 48 and the medium support surface 24*a* in the vertical direction Z intersecting with the transportation direction Y and the scanning direction X. A user may be capable of operating the adjustment mechanism 49 and the controller 31 may control driving of the adjustment mechanism 49.

Next, an embodiment of the supply mechanism 18 will be described.

The liquid ejecting apparatus 11 includes a mounting portion 51 on which at least one liquid accommodation portion 17 is mounted in a detachable manner. The liquid ejecting apparatus 11 may include the plurality of supply mechanisms 18 in accordance with the number of liquid accommodation portions 17 capable of being mounted on the mounting portion 51. In the embodiment, four liquid accommodation portions 17 can be mounted on the mounting portion 51 and the liquid ejecting apparatus 11 includes four supply mechanisms 18. The respective supply mechanisms 18 supply liquids to the corresponding liquid ejecting heads 46.

The plurality of liquid accommodation portions 17 accommodates therein different types of liquids. When the plurality of liquid accommodation portions 17 accommodates therein different colors of inks, such as cyan, magenta, yellow, and black, the liquid ejecting unit 16 ejects the plurality of colors of inks supplied from the liquid accommodation portions 17 for color printing on the medium 14. The liquid accommodation portions 17 may accommodate therein colors of inks, such as light magenta, light cyan, light yellow, gray, orange, and white, for example, and may accommodate therein a moisturizing solution and the washing solution. The types of the liquids that the liquid ejecting unit 16 ejects may be, for example, three types of cyan, magenta, and yellow, or the like or may be one type of black, or the like.

Each supply mechanism 18 includes a supply path 53 for supplying the liquid to the liquid ejecting head 46 from the liquid accommodation portion 17 mounted on the mounting portion 51. The supply mechanism 18 makes the liquid flow in a supply direction A from the upstream side as the side of the liquid accommodation portion 17 toward the downstream side as the side of the liquid ejecting head 46. On the supply path 53, a supply pump 54 making the liquid flow, a filter unit 55 catching air bubbles and foreign matters in the liquid, a static mixer 56 changing flow of the liquid in the supply path 53 to stir the liquid, a liquid storage chamber 57 storing therein the liquid, and a pressure adjustment unit 58 adjusting a pressure of the liquid are provided in this order from the upstream side in the supply direction A.

The supply pump 54 includes a diaphragm pump 60 having a pump chamber the volume of which is changeable, a suction valve 61 arranged between the diaphragm pump 60 and the liquid accommodation portion 17, and a discharge valve 62 arranged between the diaphragm pump 60 and the filter unit 55. The suction valve 61 and the discharge valve 62 are formed by one-way valves that permit flow of the ink to the downstream side and inhibit flow of the ink to the upstream side. The supply pump 54 sucks the liquid using the suction valve 61 from the liquid accommodation portion 17 side with increase in the volume of the pump chamber of the diaphragm pump 60 and discharges the liquid using the discharge valve 62 to the liquid ejecting head 46 side with decrease in the volume of the pump chamber.

The filter unit 55 is mounted on the supply path 53 in a detachable manner. The filter unit 55 is arranged at a position corresponding to the cover 13 and can be replaced by opening the cover 13.

Figure 2:
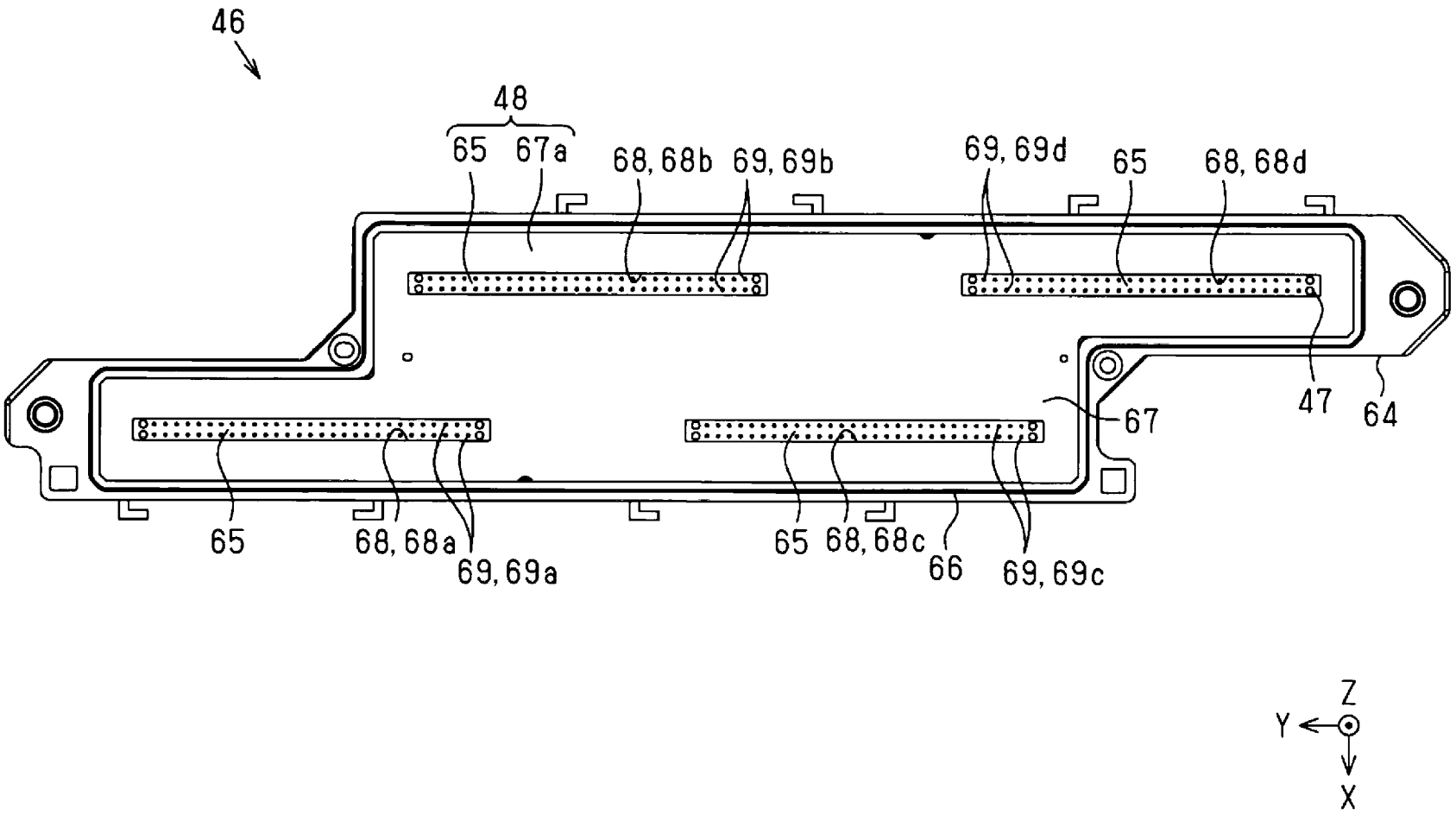
FIG. 2 is a bottom view of a liquid ejecting head.

As illustrated in FIG. 2, each liquid ejecting head 46 includes a bracket 64 for mounting the liquid ejecting head 46 on the carriage 45, a head main body 66 having a nozzle opening surface 65 in which the plurality of nozzles 47 is opened, and a plate 67 covering the nozzle opening surface 65.

The plate 67 is made of, for example, metal such as stainless steel, and has such shape that two rectangular shapes having lengthwise directions being the transportation direction Y when seen from the lower side deviate in the transportation direction Y. The plate 67 has at least one through-hole 68 formed therein. The plate 67 in the embodiment has a first through-hole 68*a* to a fourth through-hole 68*d* having rectangular shapes, which are long in the transportation direction Y. The plate 67 is fixed to the head main body 66 such that the nozzles 47 are exposed from the through-holes 68. The nozzle surface 48 is formed by the nozzle opening surface 65 exposed from the through-holes 68 and a lower surface 67*a* of the plate 67.

The plurality of through-holes 68 is formed at positions deviating from each other in the transportation direction Y. The through-holes 68 include the first through-hole 68*a*, the second through-hole 68*b*, the third through-hole 68*c*, and the fourth through-hole 68*d* in this order from the downstream side in the transportation direction Y. The second through-hole 68*b* is located at an intermediate position between the first through-hole 68*a* and the third through-hole 68*c* in the transportation direction Y. The third through-hole 68*c* is located at an intermediate position between the second through-hole 68*b* and the fourth through-hole 68*d* in the transportation direction Y.

The first through-hole 68*a* and the third through-hole 68*c* are located at the same position in the scanning direction X so as to be spaced from each other in the transportation direction Y. The second through-hole 68*b* and the fourth through-hole 68*d* are located at the same position in the scanning direction X so as to be spaced from each other in the transportation direction Y. The first through-hole 68*a* and the third through-hole 68*c* are located at positions differing from the second through-hole 68*b* and the fourth through-hole 68*d* in the scanning direction X so as to be spaced from the second through-hole 68*b* and the fourth through-hole 68*d*.

The liquid ejecting head 46 has a first nozzle group 69*a* to a fourth nozzle group 69*d* formed by the large number of nozzles 47 aligned at a constant pitch in the transportation direction Y. The first nozzle group 69*a* is exposed from the first through-hole 68*a*, the second nozzle group 69*b* is exposed from the second through-hole 68*b*, the third nozzle group 69*c* is exposed from the third through-hole 68*c*, and the fourth nozzle group 69*d* is exposed from the fourth through-hole 68*d*. The first nozzle group 69*a* and the third nozzle group 69*c* are formed at the same position in the scanning direction X so as to be aligned in a row in the transportation direction Y. The second nozzle group 69*b* and the fourth nozzle group 69*d* are formed at the same position in the scanning direction X so as to be aligned in a row in the transportation direction Y.

A part of the first nozzle group 69*a* and a part of the second nozzle group 69*b*, a part of the second nozzle group 69*b* and a part of the third nozzle group 69*c*, and a part of the third nozzle group 69*c* and a part of the fourth nozzle group 69*d* overlap with each other when seen from the scanning direction X. That is to say, the first nozzle group 69*a* to the fourth nozzle group 69*d* configure a nozzle row 69 continuous in the transportation direction Y when seen from the scanning direction X. One nozzle row 69 ejects the same type of the liquid. The liquid ejecting head 46 may have the plurality of nozzle rows 69 formed therein.

Next, the internal configuration of each liquid ejecting head 46 will be described.

Figure 3:
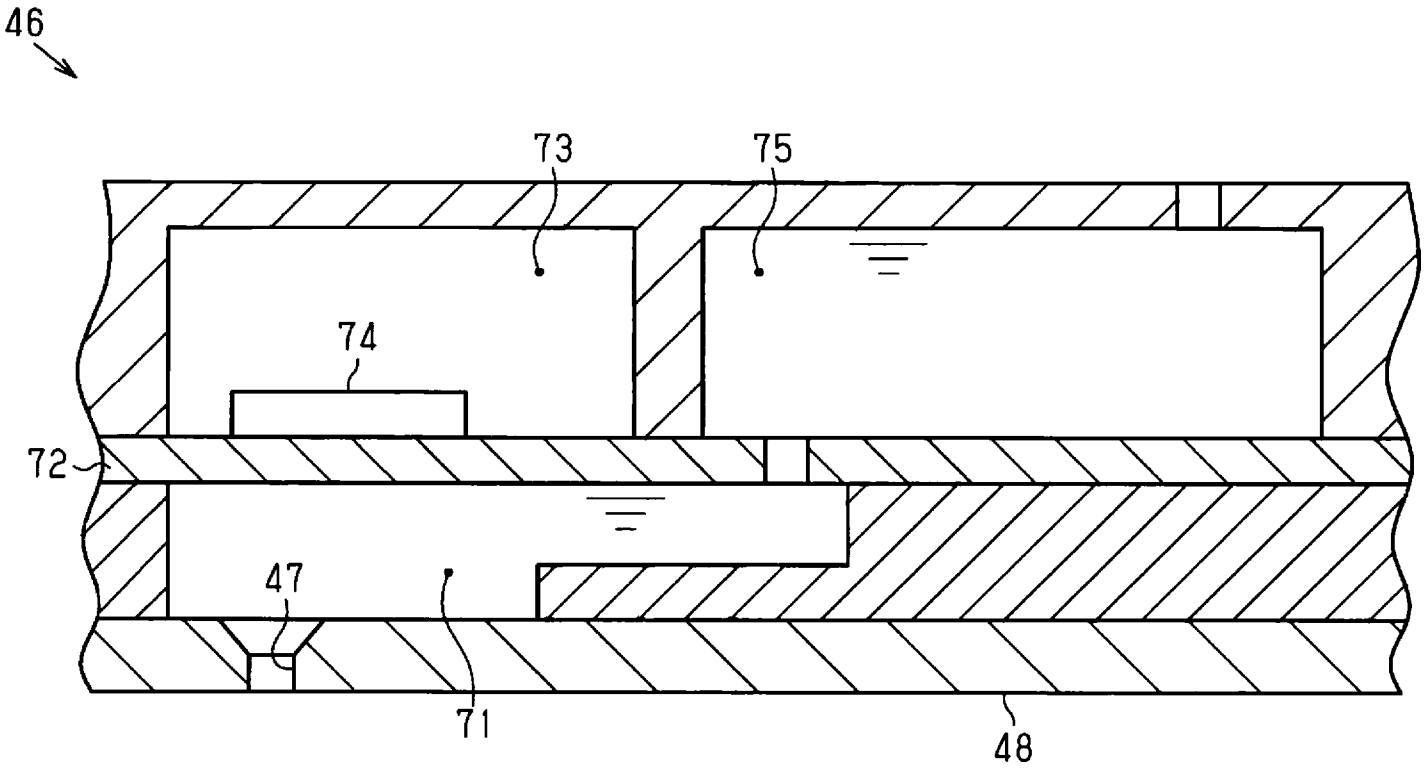
FIG. 3 is a schematic cross-sectional view of the liquid ejecting head.

As illustrated in FIG. 3, the liquid ejecting head 46 includes pressure chambers 71 communicating with the nozzles 47, accommodation portions 73 partitioned from the pressure chambers 71 by vibration plates 72, and actuators 74 accommodated in the accommodation portions 73. The liquid ejecting head 46 includes a common liquid chamber 75 that temporarily stores therein the supplied liquid and supplies the liquid to the plurality of pressure chambers 71.

The actuators 74 are piezoelectric elements that expand and contract based on input driving signals. The actuators 74 deform the vibration plates 72 to change the volumes of the pressure chambers 71. The liquid in the pressure chambers 71 is ejected as liquid droplets through the nozzles 47 with the change in the volumes of the pressure chambers 71.

Figure 4:
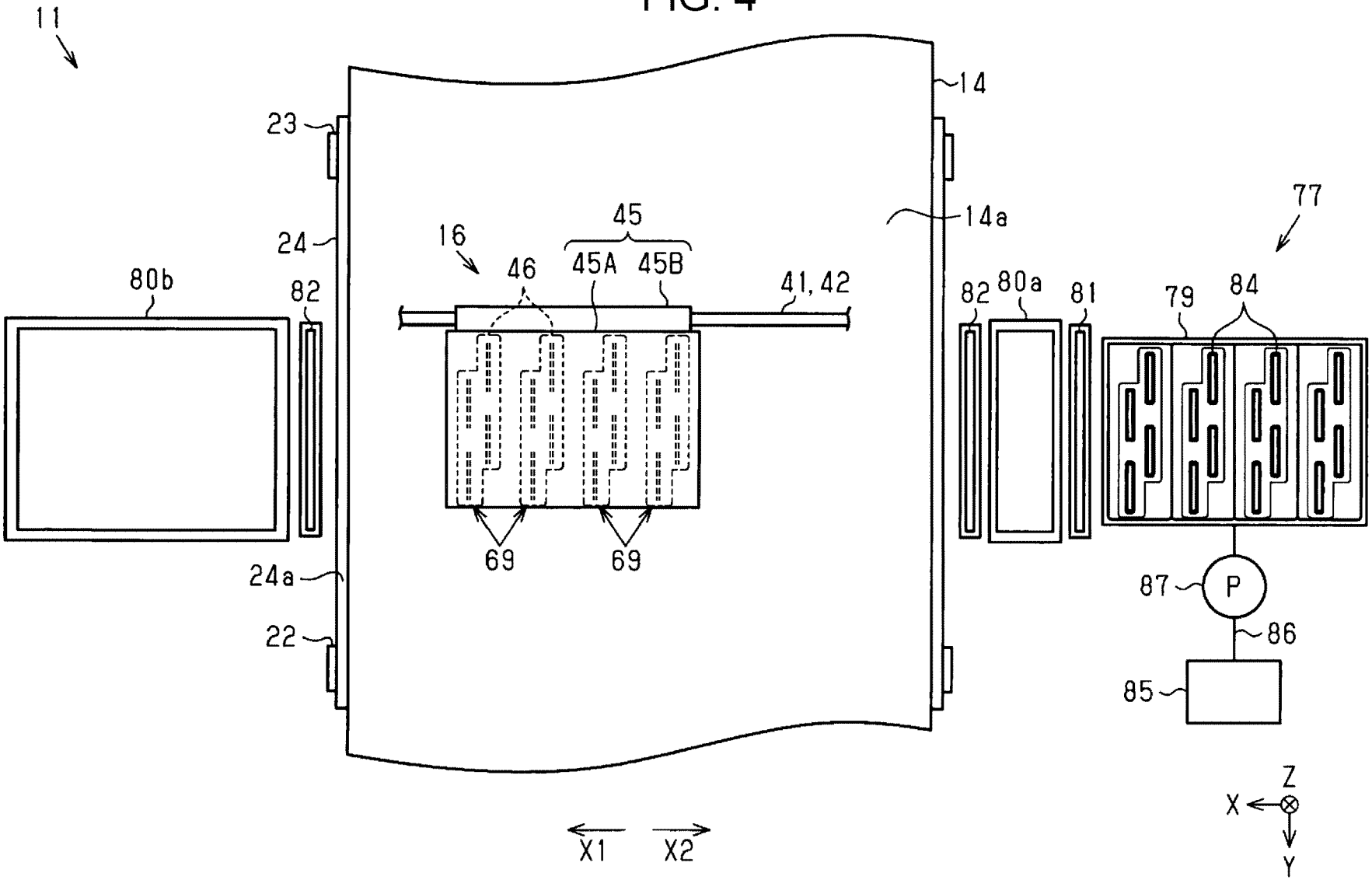
FIG. 4 is a schematic plan view illustrating the internal configuration of the liquid ejecting apparatus in FIG. 1.

As illustrated in FIG. 4, the four liquid ejecting heads 46 are aligned in parallel at a constant pitch in the scanning direction X. The configurations of the respective liquid ejecting heads 46 are the same. Therefore, the plurality of nozzle rows 69 are aligned in parallel at a constant pitch in the scanning direction X. That is to say, the plurality of nozzles 47 is arranged in the nozzle surfaces 48 so as to form the plurality of nozzle rows 69 aligned in the scanning direction X. The plurality of different types of liquids can be ejected through the plurality of nozzle rows 69.

Next, an embodiment of a maintenance mechanism 77 will be described.

The liquid ejecting apparatus 11 includes the maintenance mechanism 77 for performing maintenance of the liquid ejecting unit 16. The maintenance mechanism 77 is provided at the lower side, in the vertical direction Z, of a region in which the liquid ejecting heads 46 can be moved. The maintenance mechanism 77 performs the maintenance of the liquid ejecting unit 16 in order to prevent or eliminate clogging of the nozzles 47, mixing of air bubbles into the liquid ejecting heads 46, or ejection failure caused by adhesion of foreign matters to the peripheries of the nozzles 47.

The maintenance mechanism 77 includes a cleaning mechanism 79 that performs a cleaning operation, a first liquid receiver 80*a* and a second liquid receiver 80*b* that receive liquid discharged by a flushing operation, and a first cleaning member 81 and second cleaning members 82 that clean the liquid ejecting unit 16.

The cleaning mechanism 79 includes a suction cap 84, a suction tube 86 connecting the suction cap 84 and a waste liquid accommodation portion 85, and a suction pump 87 capable of sucking the inside of the suction cap 84. The suction pump 87 is, for example, a tube pump provided at a halfway position of the suction tube 86. At least one of the suction cap 84 and the liquid ejecting heads 46 is configured to move relatively between a capping position at which opening spaces of the nozzles 47 are close spaces and a retreat position at which the opening spaces of the nozzles 47 are open spaces. The suction cap 84 and the liquid ejecting heads 46 are arranged at the capping positions, so that capping is performed.

The suction cap 84 makes contact with the liquid ejecting heads 46 to form the close spaces by covering all of the nozzles 47 at once. The cleaning mechanism 79 performs the cleaning operation of sucking the liquid from the nozzles 47 by making a negative pressure generated by driving of the suction pump 87 to act in the close space formed by arranging the suction cap 84 at the capping position and discharging the liquid in the liquid ejecting heads 46 from the nozzles 47.

The liquid ejecting unit 16 stands by at a home position at which the cleaning mechanism 79 is arranged when printing is not performed or a power supply is turned OFF. When printing is performed, the liquid ejecting unit 16 moves alternately in a first scanning direction X1 as a direction of being farther from the home position and a second scanning direction X2 as a direction of making close to the home position.

The first liquid receiver 80*a* is provided between the transportation belt 24 and the home position and the second liquid receiver 80*b* is provided at the opposite side to the home position with respect to the transportation belt 24. The flushing operation is an operation of discarding the liquid through the nozzles 47 in order to prevent or eliminate the clogging or the like of the nozzles 47, separately from the ejection of the liquid onto the medium 14 in order to perform printing. The foreign matters, air bubbles, or denatured liquid causing the ejection failure can be discharged by the flushing operation. Examples of the denatured liquid include ink increased in viscosity. The flushing operation is executed for eliminating mild ejection failure.

The first cleaning member 81 and the second cleaning members 82 are formed into thin plate shapes by elastic members such as rubber and resin elastomer, for example. The first cleaning member 81 is provided at a position between the cleaning mechanism 79 and the first liquid receiver 80*a* in the scanning direction X. The second cleaning members 82 are arranged at positions adjacent to the transportation belt 24 in the scanning direction X. The maintenance mechanism 77 in the embodiment includes the plurality of second cleaning members 82. The second cleaning members 82 are provided at a position between the transportation belt 24 and the first liquid receiver 80*a* and a position between the transportation belt 24 and the second liquid receiver 80*b* in the scanning direction X.

Next, an embodiment of the first cleaning member 81 will be described.

Figure 5:
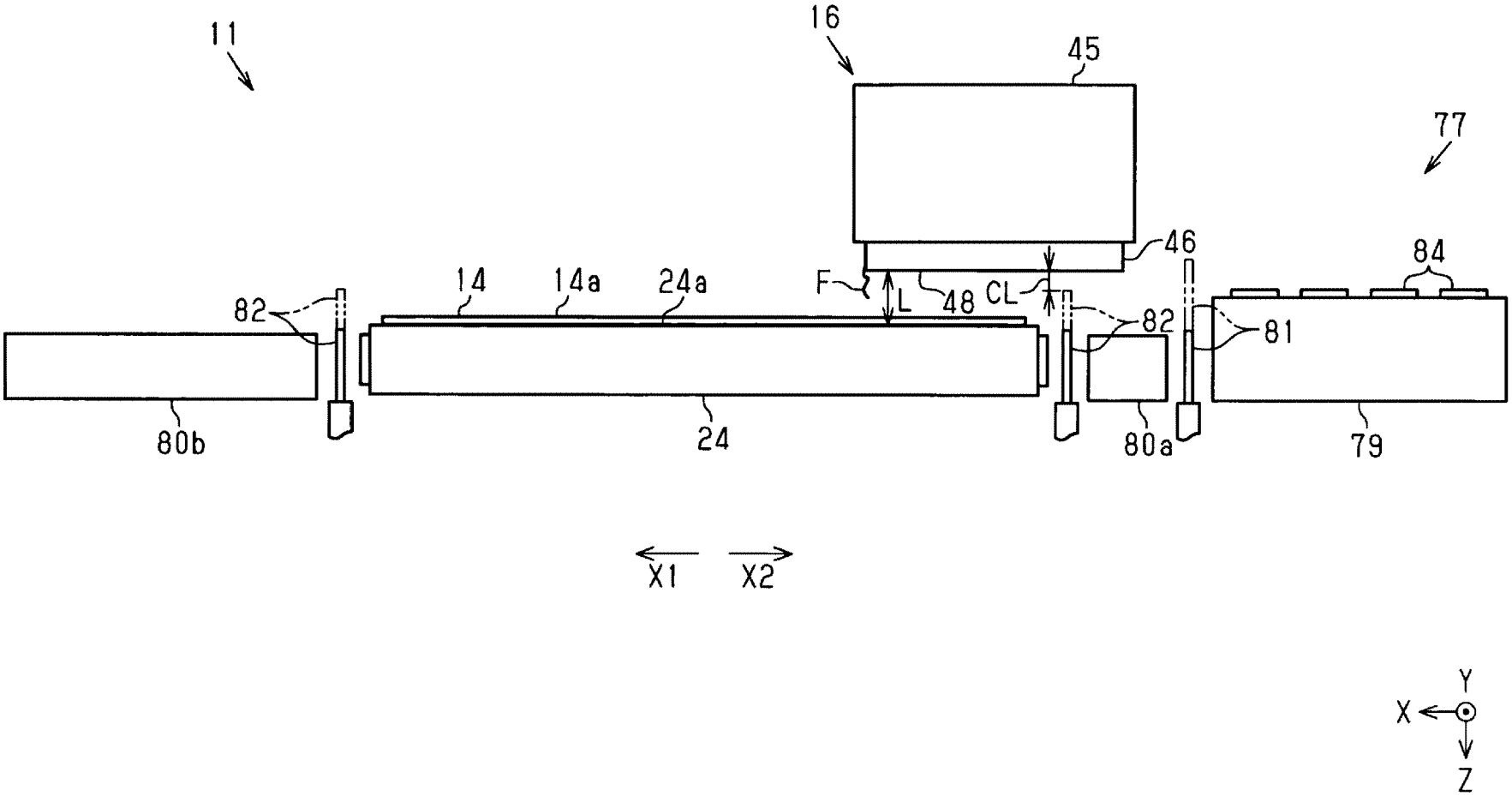
FIG. 5 is a schematic front view illustrating the internal configuration of the liquid ejecting apparatus in FIG. 1.

As illustrated in FIG. 5, at least one of the first cleaning member 81 and the liquid ejecting heads 46 is configured to move relatively in the vertical direction Z between a wiping position at which the first cleaning member 81 can wipe the nozzle surfaces 48 and a retreat position at which the first cleaning member 81 is separated from the nozzle surfaces 48 in the vertical direction Z. In FIG. 5, the wiping position of the first cleaning member 81 moving in the vertical direction Z is indicated by an alternate long and two short dashes line and the retreat position of the first cleaning member 81 is indicated by a solid line. The upper end of the first cleaning member 81 located at the wiping position is located at the upper side relative to the nozzle surfaces 48 in the vertical direction Z. The upper end of the first cleaning member 81 located at the retreat position is located at the lower side relative to the nozzle surfaces 48, more preferably, at the lower side relative to the medium 14 supported on the medium support surface 24*a*.

The first cleaning member 81 wipes the nozzle surfaces 48 by moving relative to the liquid ejecting unit 16 in the scanning direction X along the nozzle surfaces 48. To be specific, when the liquid ejecting unit 16 moves in the scanning direction X and passes through the first cleaning member 81 located at the wiping position, the first cleaning member 81 performs a wiping operation of making contact with the nozzle surfaces 48 while being elastically deformed to wipe the nozzle surfaces 48.

The wiping operation by the first cleaning member 81 is performed in a first maintenance operation of discharging the liquid through the nozzles 47 for maintenance of the liquid ejecting unit 16. For example, the liquid adheres to the nozzle surfaces 48 in the cleaning operation of discharging the liquid through the nozzles 47. Therefore, the wiping operation is preferably performed after the cleaning operation. In the wiping operation, there is a risk that menisci of the nozzles 47 are broken or foreign matters are pushed into the nozzles 47. For this reason, the flushing operation of ejecting the liquid through the nozzles 47 is preferably performed after the wiping operation. In the embodiment, a series of operations including the cleaning operation, the wiping operation, and the flushing operations are referred to as the first maintenance operation.

Next, an embodiment of the second cleaning members 82 will be described.

At least ones of the second cleaning members 82 and the liquid ejecting heads 46 are configured to move relatively in the vertical direction Z between maintenance positions and retreat positions. The maintenance positions are positions at which the second cleaning members 82 perform maintenance of the liquid ejecting unit 16. The retreat positions are positions at which the second cleaning members 82 are separated from the nozzle surfaces 48 in the vertical direction Z relative to the maintenance positions.

In FIG. 5, the maintenance positions of the second cleaning members 82 moving in the vertical direction Z are indicated by alternate long and two short dashes lines and the retreat positions of the second cleaning members 82 are indicated by solid lines. The upper ends of the second cleaning members 82 located at the maintenance positions are located between the nozzle surfaces 48 and the medium support surface 24*a* in the vertical direction Z. To be specific, the upper ends of the second cleaning members 82 located at the maintenance positions are located at the upper side, in the vertical direction Z, relative to a portion of the medium support surface 24*a*, which supports the medium 14, or a print surface 14*a* of the medium 14, which faces the nozzle surfaces 48, and are located at the lower side relative to the nozzle surfaces 48. The upper ends of the second cleaning members 82 located at the retreat positions are located at the lower side relative to the medium 14 or the print surface 14*a*.

The second cleaning members 82 perform a second maintenance operation of moving relative to the liquid ejecting unit 16 in the scanning direction X along the nozzle surfaces 48 at the maintenance positions at which they do not make contact with the nozzle surfaces 48 to remove foreign matters which have adhered to the nozzle surfaces 48. In the second maintenance operation in the embodiment, the liquid ejecting unit 16 moves in the scanning direction X so as to pass through the second cleaning members 82 located at the maintenance positions. The second maintenance operation is an operation that does not involve discharging of the liquid.

Next, the electric configuration of the liquid ejecting apparatus 11 will be described.

Figure 6:
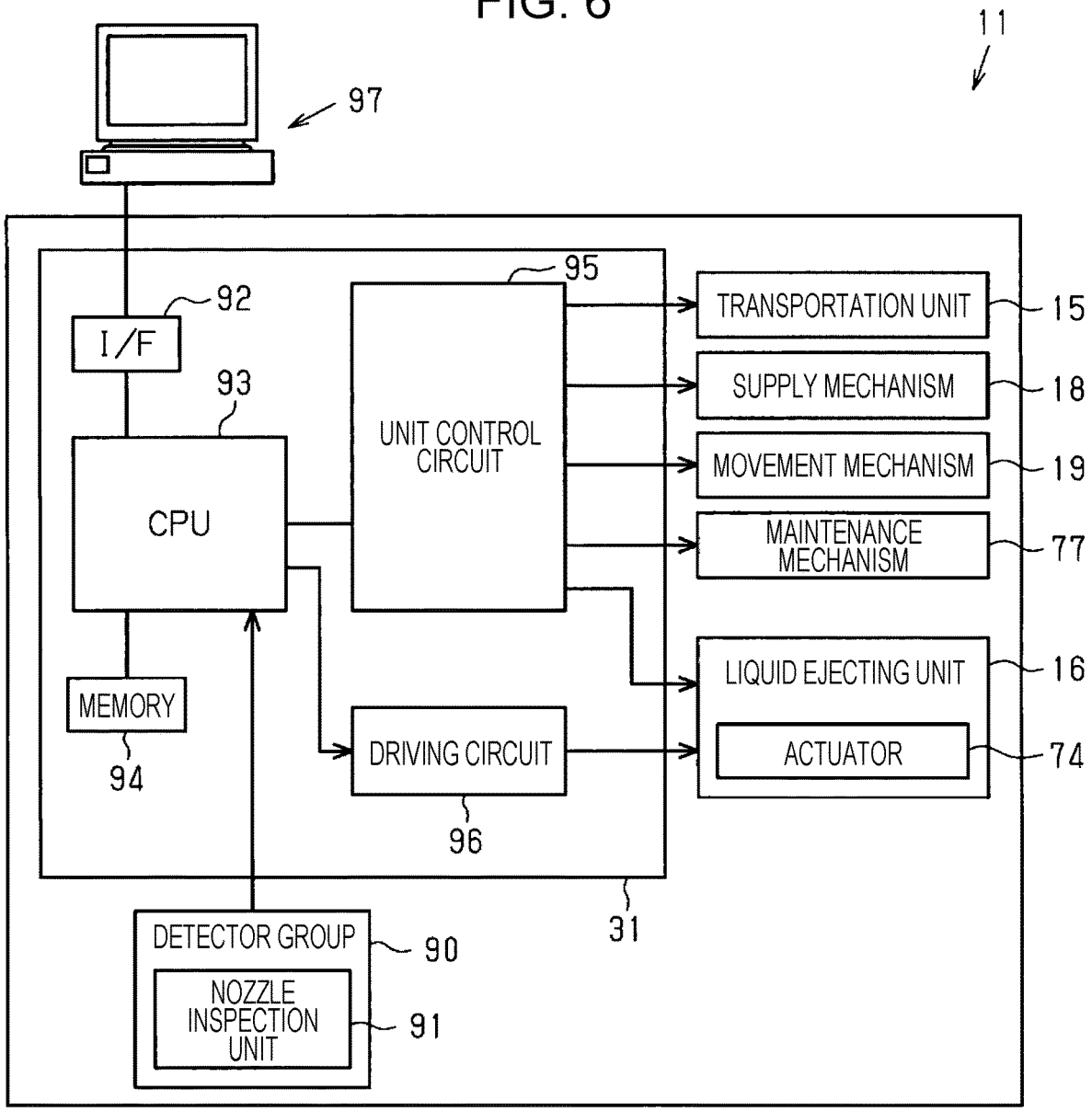
FIG. 6 is a block diagram illustrating the electric configuration of the liquid ejecting apparatus in FIG. 1.

As illustrated in FIG. 6, the liquid ejecting apparatus 11 includes the controller 31 that collectively controls the components of the liquid ejecting apparatus 11 and a detector group 90 that monitors a condition in the liquid ejecting apparatus 11. The detector group 90 outputs detection results to the controller 31.

The detector group 90 includes, for example, a linear encoder (not illustrated) that detects a movement condition of the carriage 45, a medium detection sensor (not illustrated) that detects the medium 14, and a nozzle inspection unit 91 that detects residual vibration of the pressure chambers 71 and inspects ejection states of liquid through the nozzles 47. The nozzle inspection unit 91 may include the piezoelectric elements forming the actuators 74.

The controller 31 includes an interface unit 92, a CPU (central processing unit) 93, a memory 94, a unit control circuit 95, and a driving circuit 96. The interface unit 92 transmits and receives data between a computer 97 as an external apparatus and the liquid ejecting apparatus 11. The driving circuit 96 generates the driving signals for driving the actuators 74.

The CPU 93 is an arithmetic processing device. The memory 94 is a storage device ensuring a region storing therein a program of the CPU 93, a work region, or the like, and includes a storage element such as a RAM and an EEPROM. The CPU 93 controls the transportation unit 15, the supply mechanisms 18, the movement mechanism 19, the maintenance mechanism 77, and the liquid ejecting unit 16 using the unit control circuit 95 in accordance with the program stored in the memory 94.

Nozzle Inspection

As illustrated in FIGS. 6 and 3, when a voltage is applied to the actuators 74 upon reception of the signals from the driving circuit 96, the vibration plates 72 are deformed in a deflection manner. Pressures therefore fluctuate in the pressure chambers 71 and the fluctuation causes the vibration plates 72 to vibrate for a while. The vibration is referred to as the residual vibration, and detection of the states of the pressure chambers 71 and the nozzles 47 communicating with the pressure chambers 71 based on a state of the residual vibration is referred to as nozzle inspection.

Figure 7:
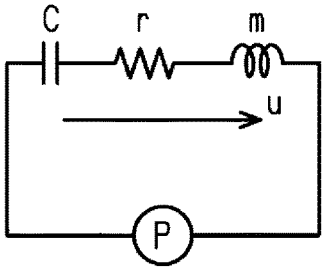
FIG. 7 is a view illustrating a calculation model of simple harmonic motion when residual vibration of a vibration plate is supposed.

FIG. 7 is a view illustrating a calculation model of simple harmonic motion when the residual vibration of the vibration plates 72 is supposed.

When the driving circuit 96 applies the driving signals to the actuators 74, the actuators 74 expand and contract in accordance with voltages of the driving signals. The vibration plates 72 deflect in accordance with the expansion and contraction of the actuators 74, the volumes of the pressure chambers 71 are thereby increased, and then, the vibration plates 72 contract. In this case, a part of the liquid filling the pressure chambers 71 is ejected as liquid droplets through the nozzles 47 with the pressures generated in the pressure chambers 71.

In the series of operations of each vibration plate 72, the vibration plate 72 freely vibrates with a natural vibration frequency that is determined by a flow path resistance r with a shape of an ink supply port, ink viscosity, and the like, an inertance m with an ink weight in the flow path, and a compliance C of the vibration plate 72. The free vibration is the residual vibration.

The calculation model of the residual vibration of the vibration plates 72 is represented by a pressure P, and the above-described inertance m, compliance C, and flow path resistance r. When step response when the pressure P is applied to a circuit in FIG. 7 is calculated for a volume speed u, the following equations are obtained.

$$u = \frac{P}{\omega \cdot m} e^{-\omega t} \cdot \sin \omega t \tag{1}$$

$$\omega = \sqrt{\frac{1}{m \cdot c} - \alpha^2} \tag{2}$$

$$\alpha = \frac{r}{2m} \tag{3}$$

Figure 8:
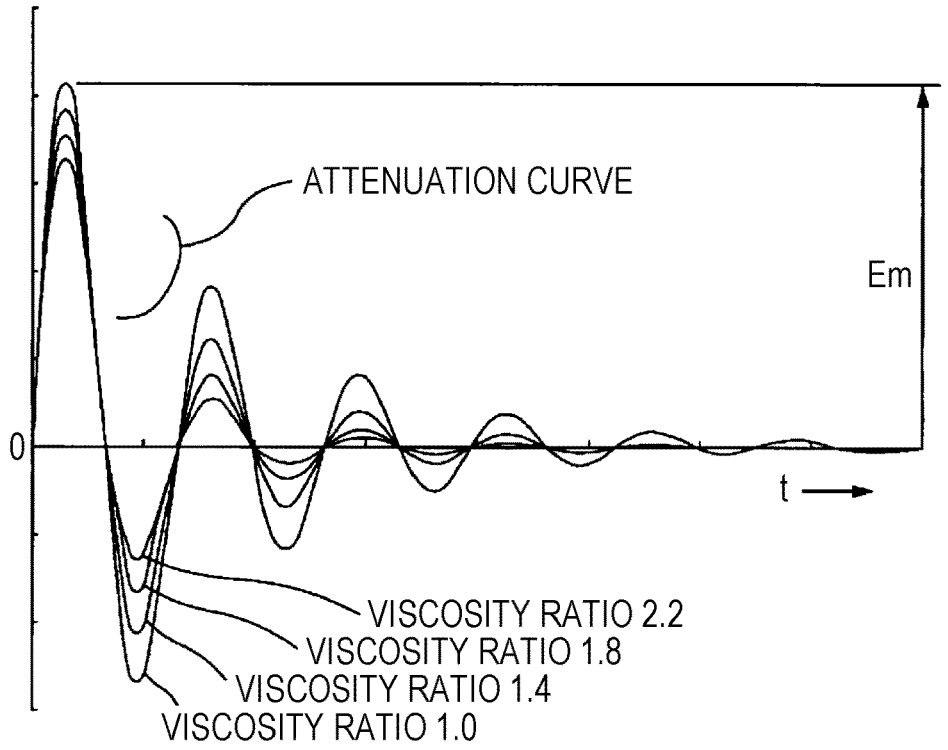
FIG. 8 is a descriptive graph for explaining a relation between increase in viscosity of ink and a residual vibration waveform.

FIG. 8 is a descriptive graph for explaining a relation between increase in the viscosity of the ink and a residual vibration waveform. A transverse axis in FIG. 8 indicates time and a longitudinal axis indicates the magnitude of the residual vibration. When the ink in the vicinity of the nozzle 47 is dried, for example, the viscosity of the ink is increased. When the ink is increased in viscosity, the flow path resistance r is increased and attenuations of a vibration cycle and the residual vibration are thereby increased.

Figure 9:
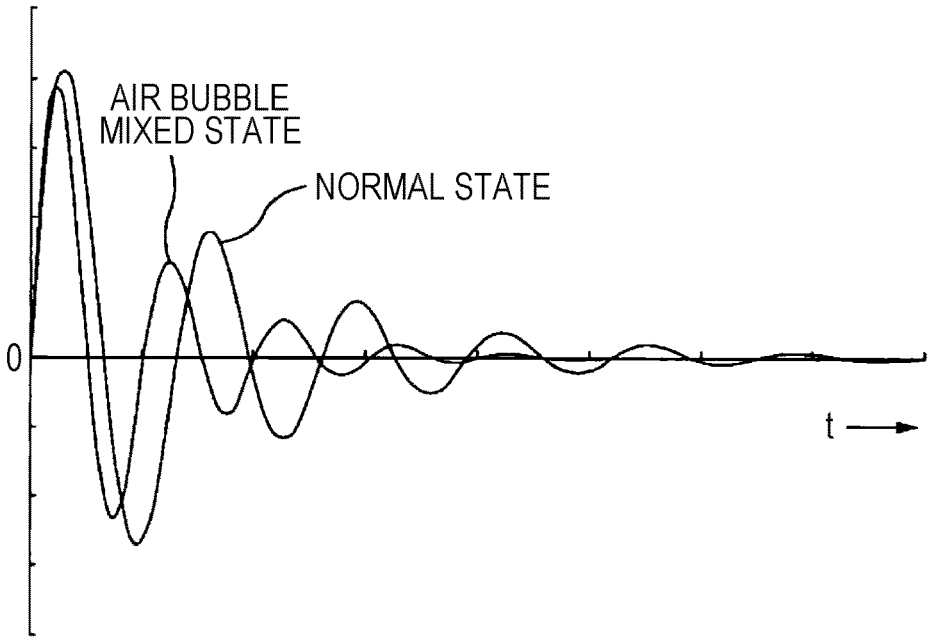
FIG. 9 is a descriptive graph for explaining a relation between mixing of air bubbles and the residual vibration waveform.

FIG. 9 is a graph view for explaining a relation between mixing of air bubbles and the residual vibration waveform. A transverse axis in FIG. 9 indicates time and a longitudinal axis indicates the magnitude of the residual vibration. For example, when the air bubbles are mixed into the ink flow path or the front end of the nozzle 47, the ink weight (=inertance m) is reduced for the mixed air bubbles in comparison with that when a state of the nozzle 47 is normal. An angular velocity ω is increased when m is decreased based on the equation (2), and the vibration cycle is therefore shortened (vibration frequency is increased).

Moreover, when foreign matters such as paper powder and fuzzes F firmly adhere to the vicinity of the opening of the nozzle 47, it is considered that the ink in the pressure chamber 71 and oozing ink when seen from the vibration plate 72 are increased in comparison with those in the normal state and the inertance m is thereby increased. Furthermore, it is considered that fibers of the paper powder which has adhered to the vicinity of an exit of the nozzle 47 increase the flow path resistance r. Accordingly, when the paper powder adheres to the vicinity of the opening of the nozzle 47, the frequency is lower than that in the normal discharge state and the frequency of the residual vibration is higher than that when the ink is increased in viscosity.

When the increase in the viscosity of the ink, the mixing of the air bubbles, firm adhesion of the foreign matters, or the like occur, the state in the nozzle 47 or the pressure chamber 71 becomes abnormal and the ink is not discharged through the nozzle 47 typically. Due to this, dot missing is generated in an image printed on the medium 14. Even when the ink droplets are discharged through the nozzle 47, the amount of the ink droplets is small, or a flying direction of the ink droplets deviate and the ink droplets do not land at desired positions in some cases. The nozzle 47 with the above-described discharge failure is referred to as an abnormal nozzle.

As described above, the residual vibration of the pressure chamber 71 communicating with the abnormal nozzle is different from the residual vibration of the pressure chambers 71 communicating with the normal nozzles 47. The nozzle inspection unit 91 detects the states in the pressure chambers 71 by detecting the vibration waveforms of the pressure chambers 71 to inspect the nozzles 47. The controller 31 may inspect the nozzles 47 based on the detection results by the nozzle inspection unit 91. The maintenance mechanism 77 performs the maintenance for eliminating the discharge failure based on a result of the nozzle inspection.

Next, actions of the liquid ejecting apparatus 11 will be described.

The controller 31 executes the first maintenance operation when the discharge failure occurs, before the printing operation is started, and so on. When the liquid ejecting apparatus 11 performs printing on the medium 14, for example, the controller 31 executes the printing operation after executing the first maintenance operation. In the first maintenance operation, the controller 31 executes the cleaning operation, the wiping operation, and the flushing operation.

As illustrated in FIG. 4, in the cleaning operation, the controller 31 drives the suction pump 87 in a state in which the liquid ejecting unit 16 located at the home position is capped with the suction cap 84 to discharge the liquid from the liquid ejecting unit 16. When the cleaning operation is finished, the controller 31 moves the cleaning mechanism 79 to the retreat position and moves the liquid ejecting unit 16 located at the home position in the first scanning direction X1.

The controller 31 moves the liquid ejecting unit 16 and executes the wiping operation, the flushing operation, and the printing operation. To be specific, the controller 31 moves the liquid ejecting unit 16 in the first scanning direction X1 so as to pass through the first cleaning member 81 located at the wiping position to execute the wiping operation. The controller 31 controls the liquid ejecting unit 16 moving in the first scanning direction X1 to eject the liquid toward the first liquid receiver 80*a* through the nozzles 47 at timing at which the liquid ejecting unit 16 passes through the first liquid receiver 80*a* to execute the flushing operation.

In the printing operation, the liquid is ejected onto the medium 14 from the liquid ejecting unit 16 for printing. When the liquid ejecting unit 16 moves to the second liquid receiver 80*b*, the controller 31 reverses the movement direction of the liquid ejecting unit 16 and transports the medium 14 in the transportation direction Y. That is to say, the controller 31 stops the liquid ejecting unit 16 moving in the first scanning direction X1, and then, moves the liquid ejecting unit 16 in the second scanning direction X2. When the liquid ejecting unit 16 moving in the second scanning direction X2 moves to the first liquid receiver 80*a*, the controller 31 reverses the movement direction of the liquid ejecting unit 16 and transports the medium 14 in the first scanning direction X1.

As illustrated in FIG. 5, the fuzzes F like fine fibers as an example of the foreign matters can be generated on the medium 14 such as a fabric when the medium 14 is rubbed. The fuzzes F adhere to the nozzle surfaces 48 in some cases. The fuzzes F tend to adhere to corners of the liquid ejecting heads 46 as the ends of the nozzle surfaces 48, spaces between the head main bodies 66 and the plates 67 illustrated in FIG. 2, and the like in such a manner of being caught by irregularities of the nozzle surfaces 48. The liquid droplets discharged through the openings of the nozzles 47 in a state in which the liquids adhering to the nozzle surfaces 48 or end portions of the fuzzes F are located in the vicinities of the openings of the nozzles 47 can adhere to the fuzzes F. When the fuzzes F make contact with the medium 14 in the state in which the liquid or the liquid droplets adhere to the fuzzes F, they can contaminate the medium 14.

When it is estimated that the foreign matters adhere to the nozzle surfaces 48 based on the inspection result by the nozzle inspection unit 91, the controller 31 causes the second maintenance operation to be executed in the printing operation. The second cleaning members 82 are located in the movement region of the liquid ejecting unit 16 reciprocating in the scanning direction X in the printing operation. Therefore, the controller 31 causes the second cleaning members 82 to be located at the maintenance positions to execute the second maintenance operation.

A cleaning distance CL between the second cleaning members 82 located at the maintenance positions and the nozzle surfaces 48 in the vertical direction Z as an example of a normal line direction of the nozzle surfaces 48 is smaller than the distance L between the nozzle surfaces 48 and the medium support surface 24*a* in the vertical direction Z. Therefore, the fuzzes F which have adhered to the liquid ejecting unit 16 easily make contact with the second cleaning members 82 rather than with the transportation belt 24. When the liquid ejecting unit 16 moving in the scanning direction X passes through the second cleaning members 82, the fuzzes F move onto the second cleaning members 82.

The above-described first embodiment provides the following effects.

1-1. The first cleaning member 81 wipes the nozzle surfaces 48 in the first maintenance operation of discharging the liquid through the nozzles 47. The second cleaning members 82 clean the nozzle surfaces 48 in the second maintenance operation of removing foreign matters which have adhered to the nozzle surfaces 48. That is to say, in the first maintenance operation, the first cleaning member 81 differing from the second cleaning members 82 to which the foreign matters possibly adhere is used. Accordingly, the risk that ejection of the liquids through the nozzles 47 becomes unstable can be reduced.

1-2. The second cleaning members 82 move relative to the liquid ejecting unit 16 at the positions at which they do not make contact with the nozzle surfaces 48. Therefore, breakage of the menisci (air-liquid interfaces) formed on the openings of the nozzles 47 can be reduced. Furthermore, the risk that the foreign matters adhering to the second cleaning members 82 move onto the nozzle surfaces 48 can be reduced. The second cleaning members 82 move relative to the liquid ejecting unit 16 at the positions closer to the nozzle surfaces 48 than the medium support surface 24*a*. Therefore, they can remove the foreign matters which possibly make contact with the medium support surface 24*a*.

1-3. The second cleaning members 82 are arranged at the positions adjacent to the transportation belt 24 in the scanning direction X being the direction in which the liquid ejecting unit 16 moves. Therefore, the second maintenance operation can be efficiently performed.

1-4. When it is estimated that the foreign matters adhere to the nozzle surfaces 48 based on the inspection result by the nozzle inspection unit 91, the controller 31 causes the second maintenance operation to be executed. Therefore, an execution frequency of the second maintenance operation can be reduced in comparison with the case in which the second maintenance operation is executed periodically, for example.

1-5. When the liquid ejecting unit 16 in which the foreign matters have adhered to the nozzle surfaces 48 performs the printing operation, ejection failure that the liquid cannot be appropriately ejected through the nozzles 47 and contaminant of the medium 14, which is caused by contact between the foreign matters and the medium 14, occur in some cases. For avoiding these problems, the second maintenance operation is performed in the printing operation on which the foreign matters adhering to the nozzles 47 are likely to give influences. Therefore, the foreign matters adhering to the nozzle surfaces 48 can be efficiently removed.

Second Embodiment

Next, a second embodiment of a liquid ejecting apparatus and a liquid ejecting apparatus maintenance method will be described with reference to the drawings. In the second embodiment, the configuration of the second cleaning member is different from that in the first embodiment. The second embodiment is substantially the same as the first embodiment in the other points. Therefore, the same reference numerals denote the same components and overlapped description thereof is thereby omitted.

Figure 10:
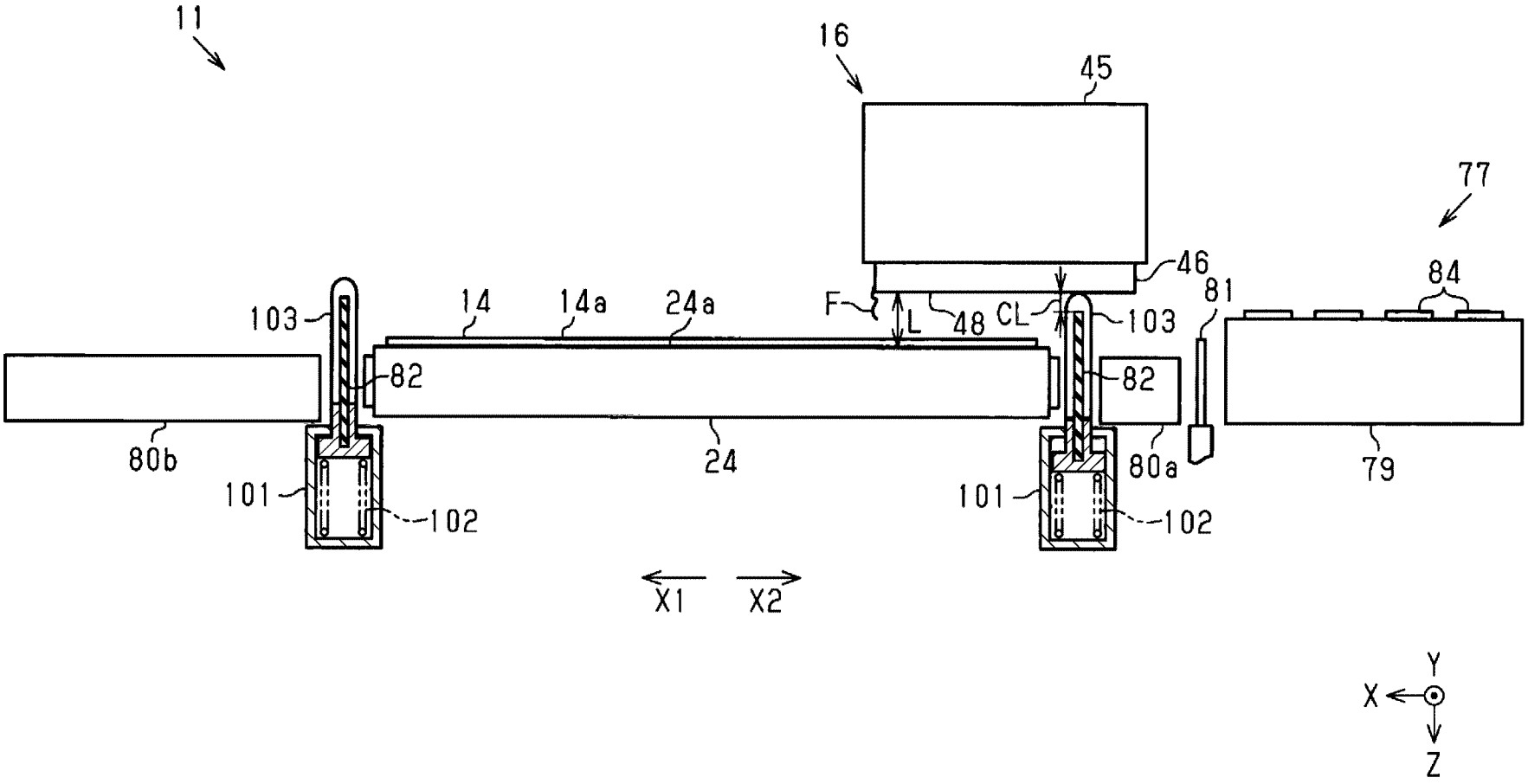
FIG. 10 is a schematic front view illustrating the internal configuration of a liquid ejecting apparatus according to a second embodiment.

As illustrated in FIG. 10, the liquid ejecting apparatus 11 includes holders 101 that hold the second cleaning members 82 in a movable manner in the vertical direction Z, biasing members 102 that bias the second cleaning members 82 to the upper side, and guiding portions 103 that guide the second cleaning members 82.

The upper ends of the guiding portions 103 are formed into semicircular shapes when seen from the front side while chamfering corners thereof in the scanning direction X, and are located at the upper side relative to the upper ends of the second cleaning members 82. The guiding portions 103 are provided so as to be movable integrally with the second cleaning members 82. To be specific, the guiding portions 103 and the second cleaning members 82 are provided so as to be movable in the vertical direction Z against biasing forces of the biasing members 102.

Figure 11:
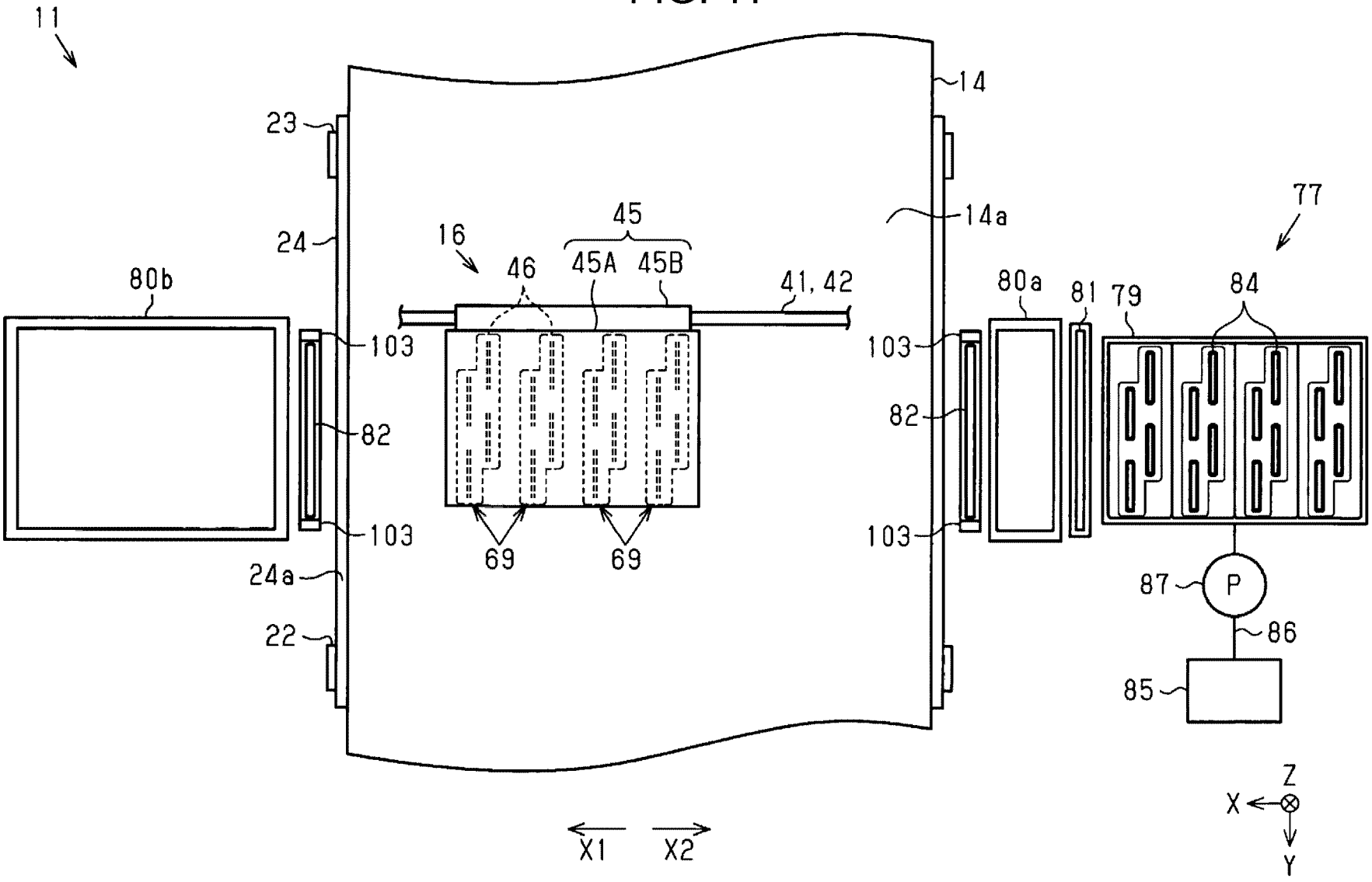
FIG. 11 is a schematic plan view illustrating the internal configuration of the liquid ejecting apparatus in FIG. 10.

As illustrated in FIG. 11, the liquid ejecting apparatus 11 can guide the second cleaning members 82 stably by providing the plurality of guiding portions 103 on each of the second cleaning members 82. The guiding portions 103 in the embodiment are provided on the second cleaning members 82 at the upstream-side positions and at the downstream-side positions so as to interpose the second cleaning members 82 in the transportation direction Y.

Next, actions of the liquid ejecting apparatus 11 will be described.

The controller 31 executes the first maintenance operation and the printing operation in the same manner as in the first embodiment. The second cleaning members 82 execute the second maintenance operation when the liquid ejecting unit 16 passes through the second cleaning members 82 after the first maintenance operation, during the printing operation, in returning of the liquid ejecting unit 16 to the home position, and so on.

As illustrated in FIG. 10, the upper ends of the guiding portions 103 are located at the upper side relative to the nozzle surfaces 48 in a state in which the liquid ejecting unit 16 is located at a position separated from the second cleaning members 82 in the scanning direction X. Therefore, when the liquid ejecting unit 16 moves in the scanning direction X and passes through the second cleaning members 82, the liquid ejecting unit 16 pushes down the guiding portions 103 against the biasing forces of the biasing members 102. The upper ends of the guiding portions 103 in this case make contact with the nozzle surfaces 48.

The second cleaning members 82 move downward together with the guiding portions 103. The cleaning distance CL between the nozzle surfaces 48 and the upper ends of the second cleaning members 82 in this case is maintained to a distance between the upper ends of the guiding portions 103 and the upper ends of the second cleaning members 82.

That is to say, the guiding portions 103 move relative to the liquid ejecting unit 16 in the state of making contact with the liquid ejecting unit 16 to maintain the cleaning distance CL between the nozzle surfaces 48 and the second cleaning members 82 in the second maintenance operation.

The above-described second embodiment can provide the following effects in addition to the effects provided by the above-described first embodiment.

2-1. The guiding portions 103 maintain the cleaning distance CL between the nozzle surfaces 48 and the second cleaning members 82 in the second maintenance operation. Therefore, the guiding portions 103 can be preferably employed as configurations stabilizing the cleaning distance CL between the nozzle surfaces 48 and the second cleaning members 82.

Third Embodiment

Next, a third embodiment of a liquid ejecting apparatus and a liquid ejecting apparatus maintenance method will be described with reference to the drawings. In the third embodiment, the configuration of the second cleaning member is different from those in the first embodiment and the second embodiment. The third embodiment is substantially the same as the first embodiment and the second embodiment in the other points. Therefore, the same reference numerals denote the same components and overlapped description thereof is thereby omitted.

Figure 12:
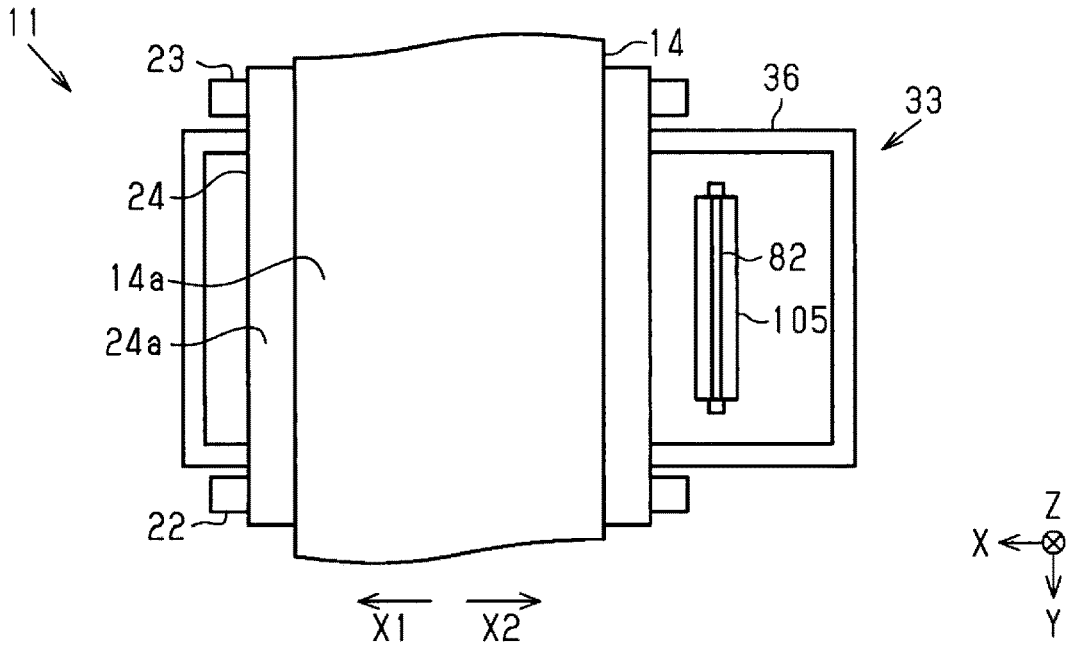
FIG. 12 is a schematic plan view illustrating the internal configuration of a liquid ejecting apparatus according to a third embodiment.
Figure 13:
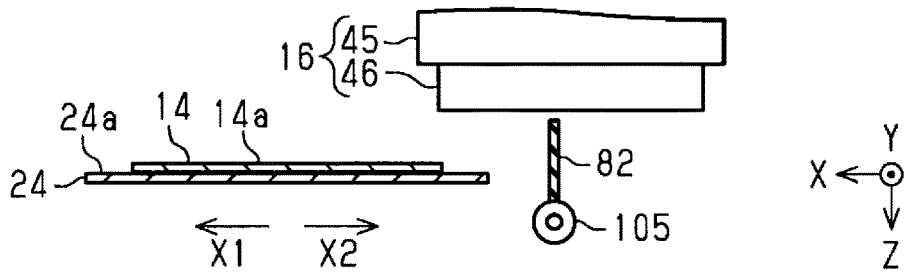
FIG. 13 is a schematic front view illustrating the internal configuration of the liquid ejecting apparatus in FIG. 12.

As illustrated in FIG. 12 and FIG. 13, the liquid ejecting apparatus 11 includes rotating portions 105 supporting the second cleaning members 82 in a rotatable manner and driving portions (not illustrated) rotating the rotating portions 105. The rotating portions 105 may be provided so as to be rotatable about axial lines intersecting with or orthogonal to the axial line of the driving pulley 22.

Figure 14:
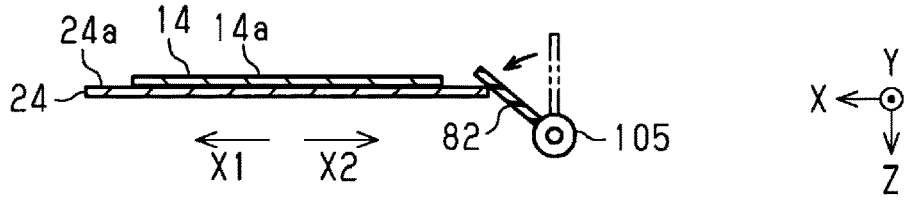
FIG. 14 is a schematic front view illustrating a state in which a second cleaning member in FIG. 13 rotates.

As illustrated in FIG. 14, the second cleaning members 82 are provided so as to make contact with the transportation belt 24. That is to say, the lengths of the second cleaning members 82 are larger than distances from the rotating portions 105 to the transportation belt 24 in the radial directions about the axial lines of the rotating portions 105.

Next, actions of the liquid ejecting apparatus 11 will be described.

As illustrated in FIG. 13, when the second maintenance operation is performed, the controller 31 moves the liquid ejecting unit 16 in the scanning direction X to pass through the second cleaning members 82 in maintenance postures. The maintenance postures are such postures that base ends of the second cleaning members 82, which are supported by the rotating portions 105, and front ends thereof at the opposite side to the base ends are located on vertical lines and the front ends of the second cleaning members 82 are located at the upper side relative to a portion of the medium support surface 24*a*, which supports the medium 14.

As illustrated in FIG. 14, when the second maintenance operation is finished, the controller 31 rotates the rotating portions 105 to cause the second cleaning members 82 and the transportation belt 24 to make contact with each other.

Figure 15:
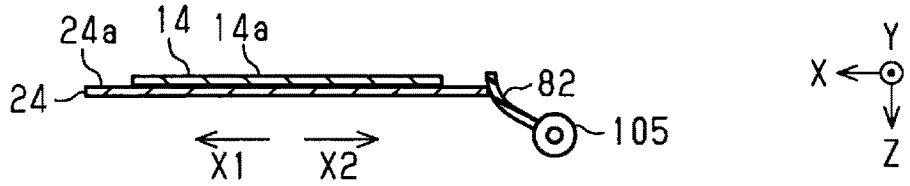
FIG. 15 is a schematic front view illustrating the state in which the second cleaning member in FIG. 13 rotates.

As illustrated in FIG. 15, the second cleaning members 82 are deformed in a deflection manner when making contact with the transportation belt 24, and foreign matters such as the fuzzes F which have adhered to the second cleaning members 82 by the second maintenance operation move onto the transportation belt 24. When the controller 31 rotates the rotating portions 105 in both of the counterclockwise direction illustrated in FIG. 14 and the clockwise direction (not illustrated), the foreign matters which have adhered to both sides of the second cleaning members 82 can be moved onto the transportation belt 24.

As illustrated in FIG. 1, the transportation belt 24 revolves with transportation of the medium 14 and is washed by the washing unit 33. That is to say, the controller 31 controls the second cleaning members 82 to make contact with the transportation belt 24, and then, performs cleaning of the transportation belt 24 by the washing unit 33.

The above-described third embodiment can provide the following effects in addition to the effects provided by the above-described first embodiment and second embodiment.

3-1. The second cleaning members 82 are provided so as to make contact with the transportation belt 24. Therefore, the foreign matters which have adhered to the second cleaning members 82 can be moved onto the transportation belt 24 by causing the second cleaning members 82 to make contact with the transportation belt 24. The foreign matters which have adhered to the transportation belt 24 can be removed from the transportation belt 24 by the washing unit 33 that cleans the transportation belt 24. Accordingly, the foreign matters which have adhered to the second cleaning members 82 can be removed by the transportation belt 24 and the washing unit 33 without exclusively providing a mechanism for removing the foreign matters which have adhered to the second cleaning members 82.

The above-described embodiments may be changed into following variations. The above-described embodiments and the following variations may be desirably combined. Configurations included in the following variations may be desirably combined.

First Variation

The relative movement of the liquid ejecting unit 16 and the second cleaning members 82 in the second maintenance operation may be performed by moving both of the liquid ejecting unit 16 and the second cleaning members 82 or by moving the second cleaning members 82 relative to the stopping liquid ejecting unit 16. The controller 31 may execute the second maintenance operation separately from the printing operation.

For example, the second cleaning members 82 may be made movable in the scanning direction X. In the second maintenance operation, the second cleaning members 82 illustrated in FIG. 4 may be moved in the scanning direction X so as to be farther from the transportation belt 24 in a state in which the liquid ejecting unit 16 is located at the home position or at a position facing the second liquid receiver 80*b*. The cleaning mechanism 79, the first liquid receiver 80*a*, the second liquid receiver 80*b*, and the first cleaning member 81 may be made movable together with the second cleaning members 82. When the second cleaning member 82 located at the cleaning mechanism 79 side relative to the transportation belt 24 is arranged between the cleaning mechanism 79 and the first cleaning member 81, a movement distance in the second maintenance operation can be decreased.

Figure 16:
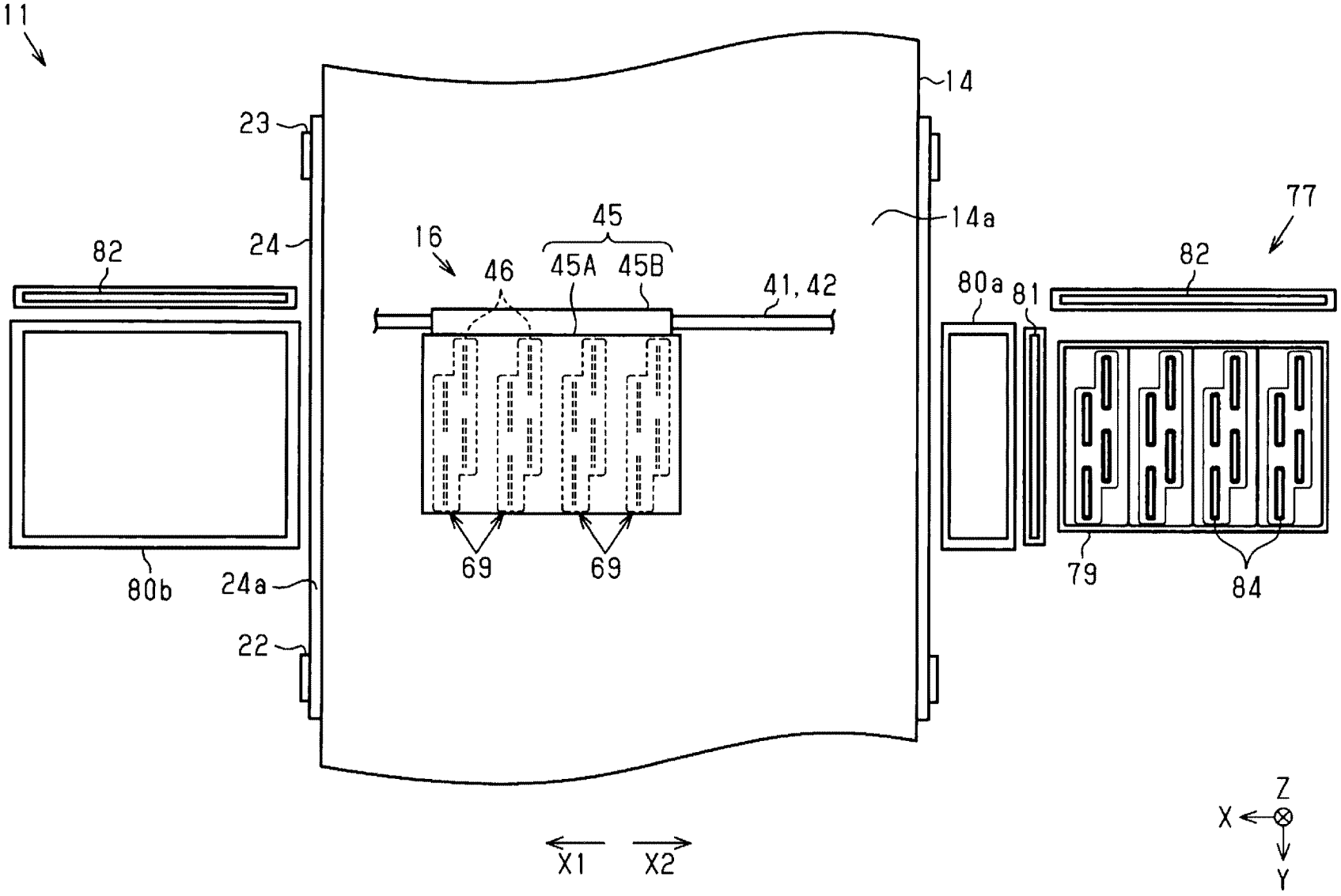
FIG. 16 is a schematic plan view illustrating the internal configuration of a liquid ejecting apparatus according to a first variation.
Figure 17:
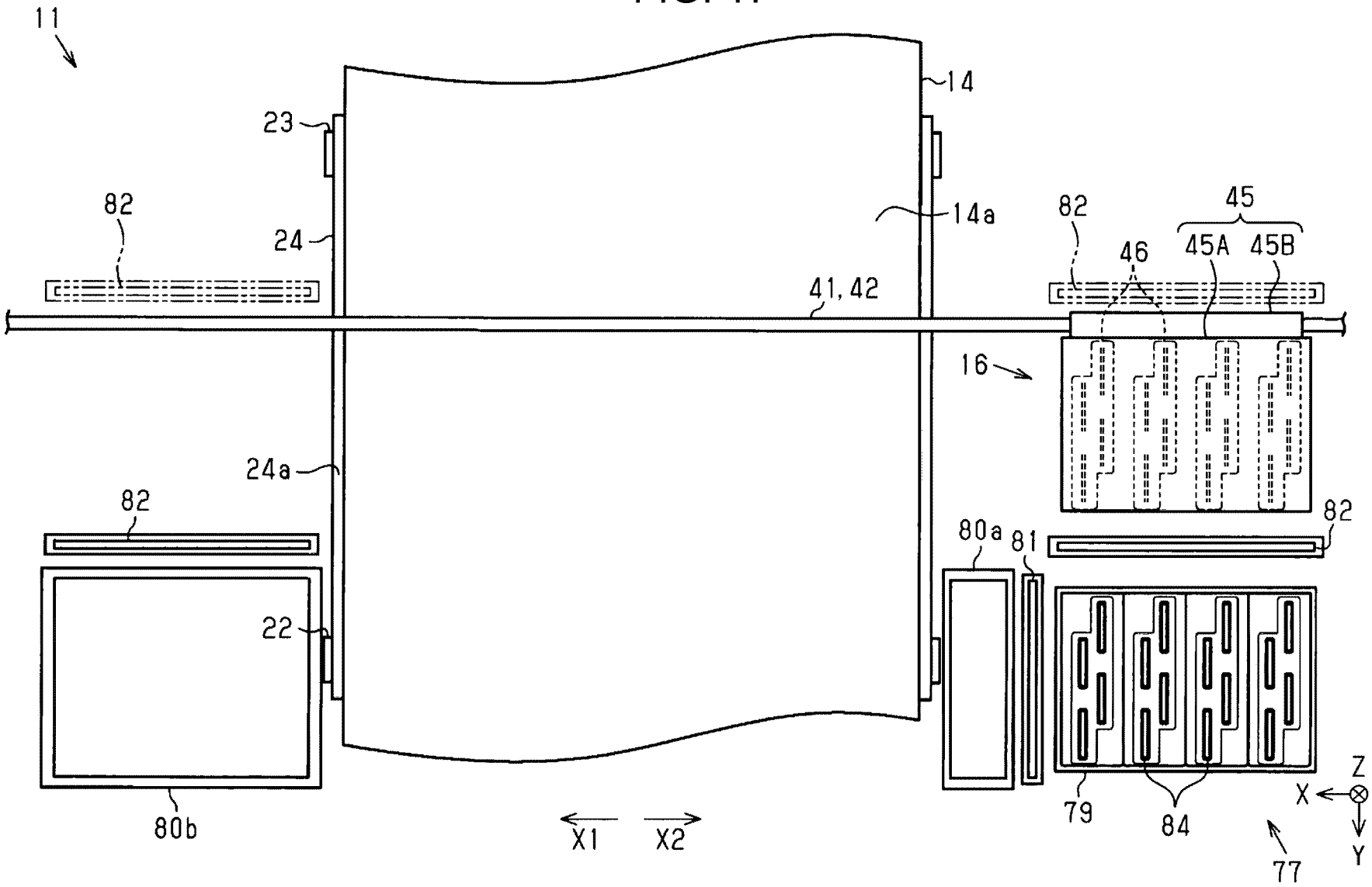
FIG. 17 is a schematic plan view illustrating a state in which a maintenance mechanism in FIG. 16 moves.

As illustrated in FIG. 16 and FIG. 17, the second cleaning members 82 may move relative to the liquid ejecting unit 16 in the transportation direction Y as an example of the direction along the nozzle surfaces 48. The liquid ejecting apparatus 11 may be configured such that the second cleaning members 82 are arranged so as to extend in the scanning direction X and the maintenance mechanism 77 is movable in the transportation direction Y. In the second maintenance operation, the maintenance mechanism 77 may be moved in the transportation direction Y in the state in which the liquid ejecting unit 16 is located at the home position or at the position facing the second liquid receiver 80*b*.

Second Variation

Figure 18:
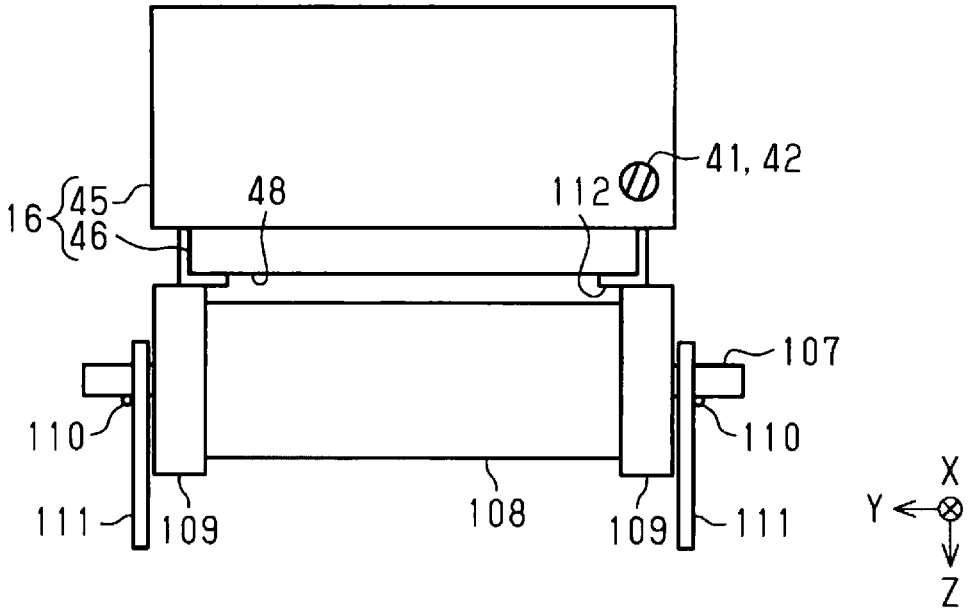
FIG. 18 is a schematic side view illustrating a cleaning roller of a liquid ejecting apparatus according to a second variation.
Figure 19:
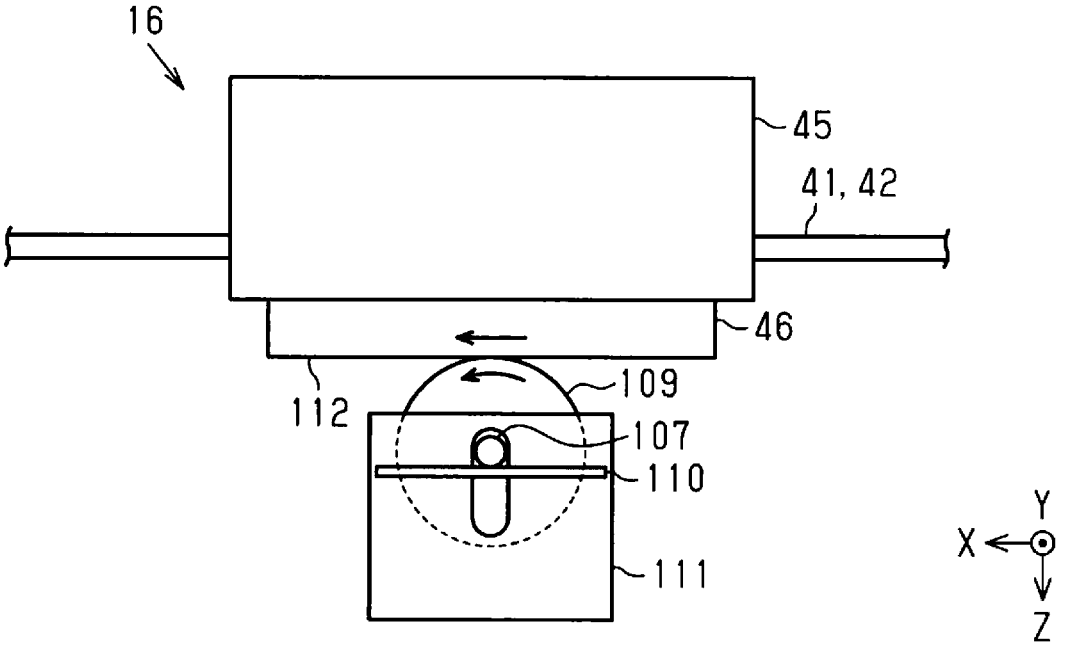
FIG. 19 is a schematic front view illustrating a guide roller in FIG. 18.

As illustrated in FIG. 18 and FIG. 19, the liquid ejecting apparatus 11 may include a cleaning roller 108 capable of being rotatable about a rotating shaft 107 extending in the transportation direction Y as an example of the second cleaning member. The liquid ejecting apparatus 11 may include guide rollers 109 capable of being rotatable about the rotating shaft 107 as an example of a guiding portion. The guide rollers 109 have diameters larger than that of the cleaning roller 108. The liquid ejecting apparatus 11 may include wire springs 110 that bias the rotating shaft 107 to the upper side. At least one of the carriage 45 and the liquid ejecting heads 46 may include a contact portion 112 capable of making contact with the guide rollers 109. When the contact portion 112 is located at the lower side relative to the nozzle surfaces 48, the diameters of the cleaning roller 108 and the guide rollers 109 may be the same. That is to say, the upper end of the cleaning roller 108 may be located at the same position as the upper ends of the guide rollers 109 in the vertical direction Z.

Support portions 111 that support the rotating shaft 107 in a rotatable manner may be made movable in the vertical direction Z. For example, the support portions 111 may be movable between a maintenance position illustrated in FIG. 18 at which the guide rollers 109 can make contact with the contact portion 112 and a retreat position (not illustrated) at which the guide rollers 109 are separated from the contact portion 112. The guide rollers 109 rotate while making contact with the contact portion 112 when the liquid ejecting unit 16 moving in the scanning direction X passes through the cleaning roller 108 located at the maintenance position in the second maintenance operation. The cleaning roller 108 rotates while following movement of the liquid ejecting unit 16 with the rotation of the guide rollers 109.

Third Variation

Figure 20:
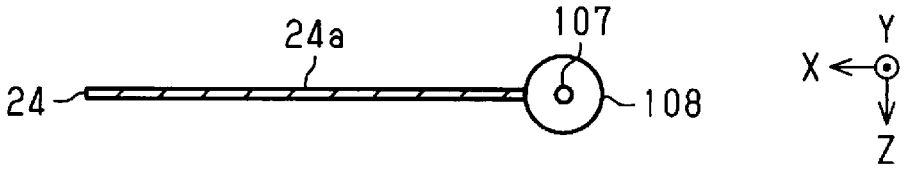
FIG. 20 is a schematic front view illustrating a cleaning roller of a liquid ejecting apparatus according to a third variation.

As illustrated in FIG. 20, the cleaning roller 108 may be arranged at a position at which it makes contact with the transportation belt 24. The controller 31 may control to clean the transportation belt 24 by the washing unit 33 in a state in which the cleaning roller 108 makes contact with the transportation belt 24. The cleaning roller 108 may move, onto the transportation belt 24, foreign matters such as the fuzzes F which have adhered to the cleaning roller 108 by rotation with sliding of the nozzle surfaces 48 and the guide rollers 109. The liquid ejecting apparatus 11 may include no guide roller 109. The cleaning roller 108 may rotate with driving force of a driving source (not illustrated) to move, onto the transportation belt 24, the foreign matters such as the fuzzes F which have adhered thereto in the second maintenance operation.

Fourth Variation

Figure 21:
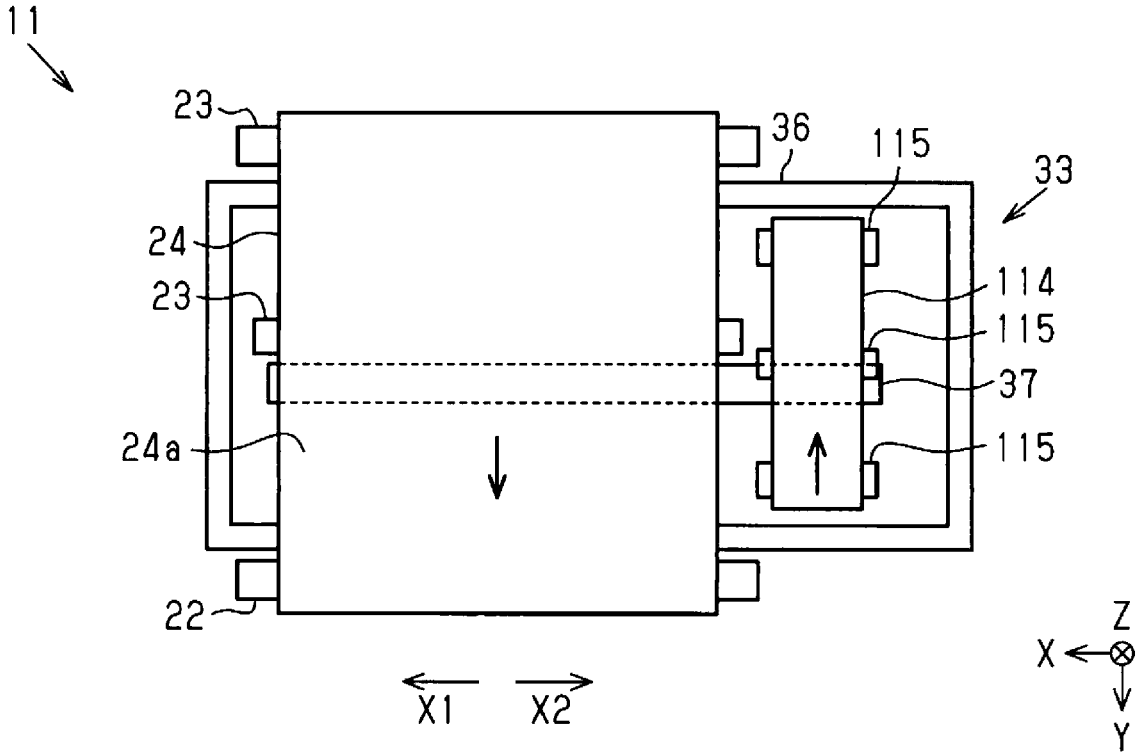
FIG. 21 is a schematic plan view illustrating a cleaning belt of a liquid ejecting apparatus according to a fourth variation.
Figure 22:
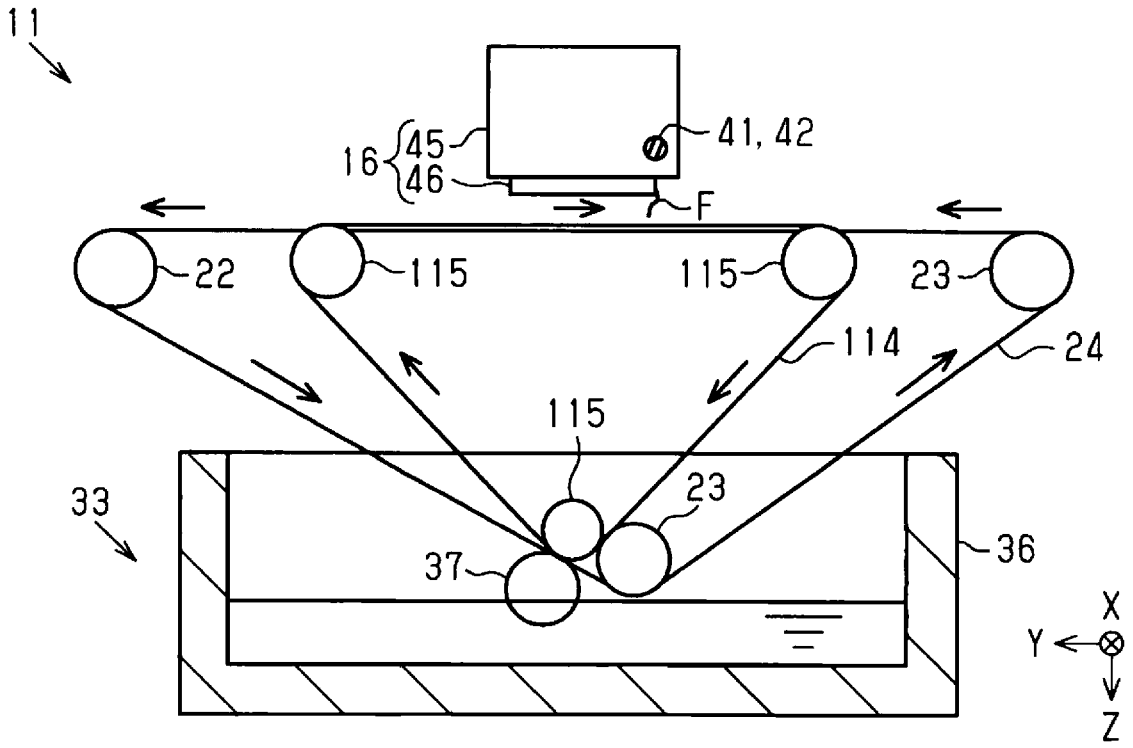
FIG. 22 is a schematic side view illustrating the cleaning belt in FIG. 21.

As illustrated in FIG. 21 and FIG. 22, the liquid ejecting apparatus 11 may include an endless cleaning belt 114 having flexibility as an example of the second cleaning member. The liquid ejecting apparatus 11 includes a plurality of rollers 115 being rotatable about axial lines extending in the scanning direction X, and the cleaning belt 114 may be wound around the rollers 115 so as to revolve. The washing unit 33 may wash the cleaning belt 114. The size of the washing brush 37 in the scanning direction X may be larger than the total size of the transportation belt 24 and the cleaning belt 114. The washing brush 37 may be arranged so as to make contact with both of the transportation belt 24 and the cleaning belt 114.

The fuzzes F tend to adhere to the upstream side in the transportation direction Y rather than to the downstream side in the transportation direction Y. Therefore, when the controller 31 controls the cleaning belt 114 to revolve in the opposite direction to the transportation belt 24, the fuzzes F which have adhered to the nozzle surfaces 48 can be efficiently removed. That is to say, the cleaning belt 114 preferably revolves such that a portion thereof facing the nozzle surfaces 48 directs toward the upstream side from the downstream side in the transportation direction Y.

Fifth Variation

Figure 23:
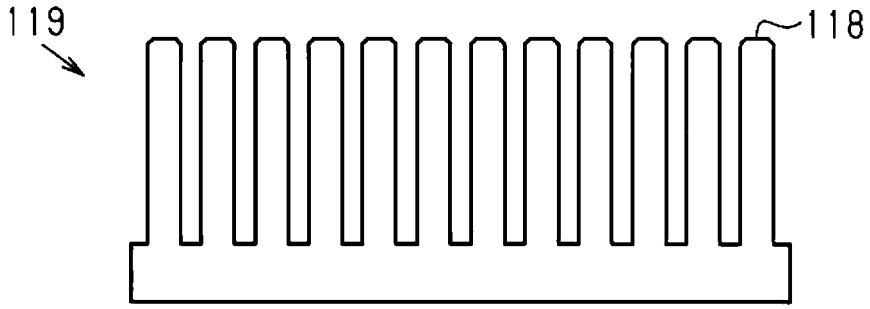
FIG. 23 is a schematic view illustrating a comb member of a liquid ejecting apparatus according to a fifth variation.

As illustrated in FIG. 23, the liquid ejecting apparatus 11 may include a comb member 119 formed by aligning elongated teeth 118 in a row in a comb-like form as an example of the second cleaning member. An interval between the teeth 118 and the teeth 118 of the comb member 119 is preferably set to such size that a capillary action occurs. The liquid making contact with the surface of the comb member 119 can thereby be sucked into between the teeth 118 and the teeth 118.

The second cleaning member 82 may be configured by combining the plurality of comb members 119. The comb members 119 having different intervals between the teeth 118 and the teeth 118 may be combined or the comb members 119 may be combined while displacing positions of the teeth 118. These combination manners enable the foreign matters to be easily removed in comparison with the case in which the comb members 119 having the same interval between the teeth 118 and the teeth 118 are combined while aligning the positions of the teeth 118.

Sixth Variation

Figure 24:
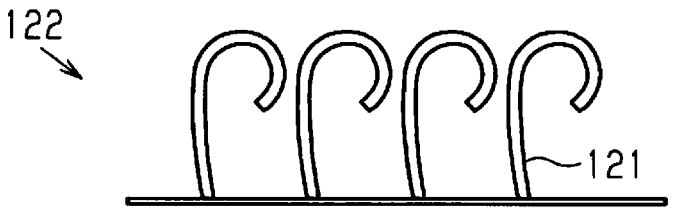
FIG. 24 is a schematic view illustrating a tape of a liquid ejecting apparatus according to a sixth variation.

As illustrated in FIG. 24, the liquid ejecting apparatus 11 may include a tape 122 formed by raising fibers 121 the front ends of which are curved in hook-like forms as an example of the second cleaning member. The fibers 121 may be raised on the surface of the second cleaning member 82, the cleaning roller 108, the cleaning belt 114, or the like.

Seventh Variation

Figure 25:
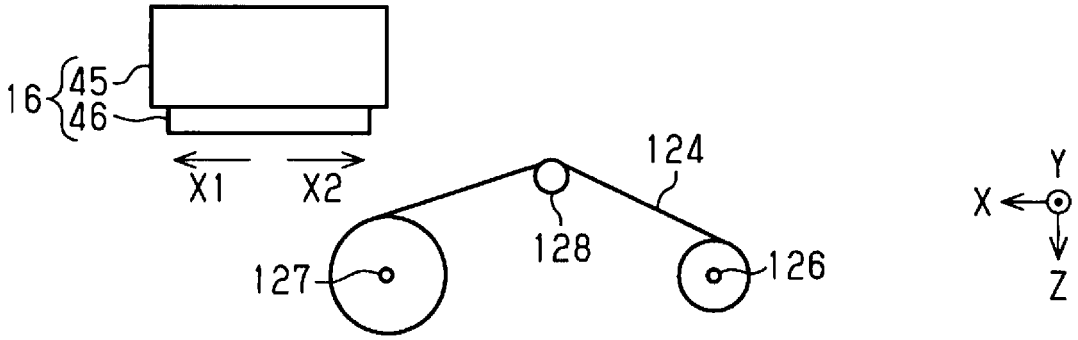
FIG. 25 is a schematic view illustrating an absorbent of a liquid ejecting apparatus according to a seventh variation.

As illustrated in FIG. 25, at least one of the first cleaning member 81 and the second cleaning members 82 may be a long absorbent 124 formed by a band-like fabric or a string-like fiber-based member made of, for example, natural fibers, chemical fibers, or the like. In the wiping operation or the second maintenance operation by the long absorbent 124, foreign matters such as liquid, which have adhered to the nozzle surfaces 48, can be absorbed by or be made to adhere to the absorbent 124 so as to be caught.

The liquid ejecting apparatus 11 includes a feeding roller 126 formed by winding and overlapping the long absorbent 124 in a roll form, a winding roller 127 winding up the absorbent 124 unrolled from the feeding roller 126, and an intermediate roller 128 located at a position between the feeding roller 126 and the winding roller 127. The feeding roller 126, the winding roller 127, and the intermediate roller 128 holding the band-like absorbent 124 are preferably arranged such that axial lines thereof extend in the transportation direction Y.

Eighth Variation

Figure 26:
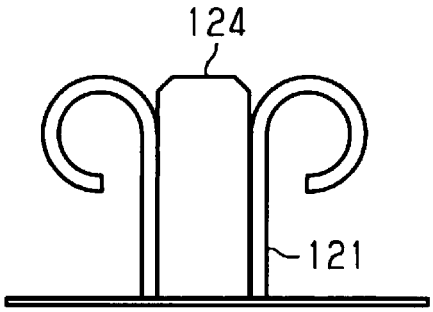
FIG. 26 is a schematic view illustrating a second cleaning member of a liquid ejecting apparatus according to an eighth variation.

As illustrated in FIG. 26, at least one of the first cleaning member 81 and the second cleaning members 82 may be formed by a plate-like absorbent 124 capable of absorbing liquid. When the second cleaning members 82 are formed by the absorbents 124, the liquid which has adhered to the fuzzes F and the liquid as foreign matters can be efficiently collected by the second cleaning members 82.

The liquid ejecting apparatus 11 may include the second cleaning member formed by combining a plurality of different members. For example, as illustrated in FIG. 26, the absorbent 124 capable of absorbing the liquid may be arranged between the fibers 121. With this configuration, the fuzzes F can be caught by the fibers 121 and the liquid which has adhered to the fuzzes F can be absorbed by the absorbent 124. When the absorbent 124 and the comb member 119 are combined, the absorbent 124 is preferably arranged at the transportation belt 24 side relative to the comb member 119 in the scanning direction X.

The second cleaning members 82 may be formed by viscous rollers or viscous belts. The second cleaning members 82 may be configured by brushes or strings.

The shapes of the upper ends of the guiding portions 103 can be desirably selected as long as the guiding portions 103 are moved downward and get under the liquid ejecting unit 16 when making contact with the liquid ejecting unit 16 moving in the scanning direction X, such as semielliptical shapes, triangular shapes, and trapezoidal shapes.

The corners of the guiding portions 103 in the scanning direction X may not be chamfered. For example, the configuration in which a slope is provided on the liquid ejecting unit 16, and the slope pushes down the guiding portions 103 when the liquid ejecting unit 16 and the guiding portions 103 make contact with each other may be employed.

The first maintenance operation may be an operation provided by combining the cleaning operation and the wiping operation. The first maintenance operation may be an operation provided by combining the wiping operation and the flushing operation.

The distance L between the nozzle surfaces 48 and the medium support surface 24*a* may be changed in accordance with the thickness of the medium 14. For example, the adjustment mechanism 49 may move the liquid ejecting heads 46 in the vertical direction Z such that a distance between the print surface 14*a* of the medium 14, which can face the nozzle surfaces 48, and the nozzle surfaces 48 is constant. The controller 31 may change the maintenance positions of the second cleaning members 82 in accordance with the distance L between the nozzle surfaces 48 and the medium support surface 24*a* such that the cleaning distance CL between the nozzle surfaces 48 and the second cleaning members 82 is constant.

The transportation belt 24 may electrostatically attract the medium 14 and support it. For example, the liquid ejecting apparatus 11 may include a charging mechanism that charges the medium 14 and the charged medium 14 and the transportation belt 24 may electrostatically attract each other.

The maintenance mechanism 77 may not include at least one of the first liquid receiver 80*a* and the second liquid receiver 80*b*. For example, the maintenance mechanism 77 may be configured such that the liquid discharged through the nozzles 47 by the flushing operation is received by the suction cap 84.

The maintenance mechanism 77 may include a leaving cap for capping the liquid ejecting heads 46 when the liquid is not ejected to form the close spaces by covering all of the nozzles 47 at once. When the leaving cap is provided, it is preferable that the leaving cap be provided at a position farther from the transportation belt 24 relative to the cleaning mechanism 79 in the scanning direction X. The leaving cap is used for suppressing evaporation of the ink in the respective nozzles 47 of the liquid ejecting heads 46 in a printing-stopped state or in a non-use state, and so on, thereby preventing occurrence of ejection failure.

The liquid ejecting apparatus 11 may include no washing unit 33. The liquid ejecting apparatus 11 may include a cleaning mechanism that cleans the second cleaning members 82 separately from the washing unit 33 that cleans the transportation belt 24. Cleaning of the second cleaning members 82 is not limited to washing and, for example, the foreign matters which have adhered to the second cleaning members 82 may be removed from the second cleaning members 82 by a brush, a wiper, or the like.

The liquid ejecting apparatus 11 may include no nozzle inspection unit 91. The controller 31 may execute the second maintenance operation regardless of the states of the nozzle surfaces 48. For example, the controller 31 may execute the second maintenance operation at predetermined timing. The controller 31 may change the timing at which the second maintenance operation is executed in accordance with the type of the medium 14. When printing is made on a fabric on which the fuzzes F tend to be generated, the controller 31 may execute the second maintenance operation at a short time interval in comparison with that when printing is made on a resin sheet on which the fuzzes F are hardly generated.

The first cleaning member 81 may wipe the nozzle surfaces 48 by moving in the transportation direction Y along the nozzle surfaces 48.

The second cleaning members 82 may be arranged at positions farther from the transportation belt 24. The second cleaning member 82 may be arranged, for example, between the first liquid receiver 80*a* and the first cleaning member 81.

The liquid ejecting apparatus 11 may be a line printer that performs the printing operation without moving the liquid ejecting unit 16. The liquid ejecting apparatus 11 may be a lateral-type printer that moves the liquid ejecting unit 16 in the scanning direction X and the transportation direction Y.

The liquid ejecting apparatus 11 may include no guiding portion 103.

The guiding portions 103 may be capable of making contact with the carriage 45.

The second cleaning members 82 may be configured so as not to be moved from the maintenance positions.

The second cleaning members 82 may make contact with the nozzle surfaces 48 in the second maintenance operation. The upper ends of the second cleaning members 82 located at the maintenance positions are preferably located at the lower side relative to the upper ends of the first cleaning member 81 located at the wiping position. Force of pressing the nozzle surfaces 48 when the second cleaning members 82 make contact with the nozzle surfaces 48 in the second maintenance operation is preferably smaller than force of pressing the nozzle surfaces 48 when the first cleaning member 81 makes contact with the nozzle surfaces 48 in the first maintenance operation.

The medium support portion supporting the medium 14 is not limited to the transportation belt 24 that revolves to transport the medium 14 and may be a support table that supports the medium 14 to be transported in a sliding manner.

The liquid ejecting apparatus may be a liquid ejecting apparatus that ejects and discharges liquid other than the ink. The state of liquid which is discharged from the liquid ejecting apparatus for a trace amount of liquid droplets includes a granule form, a teardrop form, and a form that pulls tails in a string-like form therebehind. The term "liquid" here represents materials which can be ejected from the liquid ejecting apparatus. For example, any materials are included as long as the materials are in a liquid phase. For example, materials in a liquid state having high viscosity or low viscosity or a fluid state such as sol, gel water, other inorganic solvents, an organic solvent, a solution, liquid resin, or liquid metal (molten metal) can be included as the liquid. Further, the liquid is not limited to liquid as one state of a material but includes a solution, a dispersion or a mixture of particles of a functional material made of a solid material such as pigment or metal particles. Typical examples of the liquid are ink described in the above embodiments and liquid crystals. The term "ink" here encompasses various liquid compositions such as common aqueous ink and oil ink, gel ink and hot melt ink. Specific examples of the liquid ejecting apparatus include a liquid ejecting apparatus which ejects liquid in a form of a dispersion or a solution of a material such as an electrode material or a coloring material. The material such as the electrode material or the coloring material is used for manufacturing a liquid crystal display, an electroluminescence (EL) display, a surface emitting display, or a color filter, for example. Further, the specific examples of the liquid ejecting apparatus include a liquid ejecting apparatus which ejects a bioorganic material to be used for manufacturing a biochip, a liquid ejecting apparatus which ejects liquid to be used as a precision pipette and serving as a sample, a printing device, and a micro dispenser. Other examples of the liquid ejecting apparatus include a liquid ejecting apparatus which pinpoint-ejects lubricating oil to a precision machine such as a watch or a camera. Further, a liquid ejecting apparatus which ejects a transparent resin solution of an ultraviolet curable resin or the like onto a substrate in order to form a hemispherical microlens (optical lens) to be used for an optical communication element and the like is included as the liquid ejecting apparatus. In addition, a liquid ejecting apparatus which ejects an acid or alkali etching solution for etching a substrate or the like may be employed as the liquid ejecting apparatus.

The following describes technical ideas and action effects thereof that are grasped from the above-described embodiments and variations.

Idea 1

A liquid ejecting apparatus including a medium support portion that has a medium support surface for supporting a medium, a liquid ejecting unit that ejects liquid onto the medium supported on the medium support surface through a plurality of nozzles arranged in a nozzle surface, a first cleaning member that wipes the nozzle surface by moving relative to the liquid ejecting unit in a direction along the nozzle surface in a first maintenance operation of discharging the liquid through the nozzles for maintenance of the liquid ejecting unit, and a second cleaning member that removes foreign matters which have adhered to the nozzle surface by moving relative to the liquid ejecting unit in the direction along the nozzle surface in a second maintenance operation of removing the foreign matters.

With this configuration, the first cleaning member wipes the nozzle surface in the first maintenance operation of discharging the liquid through the nozzles. The second cleaning member cleans the nozzle surface in the second maintenance operation of removing the foreign matters which have adhered to the nozzle surface. That is to say, in the first maintenance operation, the first cleaning member differing from the second cleaning member to which the foreign matters possibly adhere is used. Accordingly, the risk that ejection of the liquid through the nozzles becomes unstable can be reduced.

Idea 2

The liquid ejecting apparatus according to Idea 1, wherein in the second maintenance operation, the second cleaning member moves relative to the liquid ejecting unit in the direction along the nozzle surface at a position at which a distance to the nozzle surface in a normal line direction of the nozzle surface is smaller than a distance between the nozzle surface and the medium support surface in the normal line direction and the second cleaning member does not make contact with the nozzle surface.

With this configuration, the second cleaning member moves relative to the liquid ejecting unit at the position at which it does not make contact with the nozzle surface. Therefore, breakage of menisci (air-liquid interfaces) formed on openings of the nozzles can be reduced. Furthermore, the risk that the foreign matters adhering to the second cleaning member move onto the nozzle surface can be reduced. The second cleaning member moves relative to the liquid ejecting unit at a position closer to the nozzle surface than the medium support surface. Therefore, it can remove the foreign matters which possibly make contact with the medium support surface.

Idea 3

The liquid ejecting apparatus according to Idea 2, including a guiding portion that is provided so as to be movable integrally with the second cleaning member, and moves relative to the liquid ejecting unit in a state of making contact with the liquid ejecting unit to maintain a distance between the nozzle surface and the second cleaning member in the second maintenance operation.

With this configuration, the guiding portion maintains the distance between the nozzle surface and the second cleaning member in the second maintenance operation. Therefore, the guiding portion can be preferably employed as a configuration stabilizing the distance between the nozzle surface and the second cleaning member.

Idea 4

The liquid ejecting apparatus according to any one of Idea 1 to Idea 3, wherein the second cleaning member is formed by an absorbent capable of absorbing the liquid.

With this configuration, the second cleaning member is formed by the absorbent, so that liquid which has adhered to the foreign matters and liquid as the foreign matters can be efficiently collected by the second cleaning member.

Idea 5

The liquid ejecting apparatus according to any one of Idea 1 to Idea 4, wherein the liquid ejecting unit ejects the liquid while moving in a scanning direction relative to the medium supported on the medium support surface, and the second cleaning member is arranged at a position adjacent to the medium support portion in the scanning direction.

With this configuration, the second cleaning member is arranged at the position adjacent to the medium support portion in the scanning direction being the direction in which the liquid ejecting unit moves. Therefore, the second maintenance operation can be efficiently performed.

Idea 6

The liquid ejecting apparatus according to any one of Idea 1 to Idea 5, including a cleaning mechanism that cleans the medium support portion, wherein the second cleaning member is provided so as to make contact with the medium support portion.

With this configuration, the second cleaning member is provided so as to make contact with the medium support portion. Therefore, the foreign matters which have adhered to the second cleaning member can be made to move onto the medium support portion by causing the second cleaning member to make contact with the medium support portion. The foreign matters which have adhered to the medium support portion can be removed from the medium support portion by the cleaning mechanism that cleans the medium support portion. Accordingly, the foreign matters which have adhered to the second cleaning member can be removed by the medium support portion and the cleaning mechanism without exclusively providing a mechanism for removing the foreign matters which have adhered to the second cleaning member.

Idea 7

The liquid ejecting apparatus according to any one of Idea 1 to Idea 6, including a nozzle inspection unit that inspects an ejection state of the liquid through the nozzles, and a controller that causes the second maintenance operation to be executed when it is estimated that the foreign matters adhere to the nozzle surface based on an inspection result by the nozzle inspection unit in a printing operation of ejecting the liquid onto the medium from the liquid ejecting unit for printing.

With this configuration, when it is estimated that the foreign matters adhere to the nozzle surface based on the inspection result by the nozzle inspection unit, the controller causes the second maintenance operation to be executed. Therefore, an execution frequency of the second maintenance operation can be reduced in comparison with the case in which the second maintenance operation is executed periodically, for example.

Idea 8

A liquid ejecting apparatus maintenance method for maintaining a liquid ejecting apparatus including a medium support portion that has a medium support surface for supporting a medium, a liquid ejecting unit that ejects liquid onto the medium supported on the medium support surface through a plurality of nozzles arranged in a nozzle surface, a first cleaning member, and a second cleaning member, the method including wiping the nozzle surface by moving the first cleaning member relative to the liquid ejecting unit in a direction along the nozzle surface in a first maintenance operation of discharging the liquid through the nozzles for maintenance of the liquid ejecting unit, and removing foreign matters which have adhered to the nozzle surface by moving the second cleaning member relative to the liquid ejecting unit in the direction along the nozzle surface in a second maintenance operation of removing the foreign matters.

This method can provide the same effects as those provided by the above-described liquid ejecting apparatus.

Idea 9

The liquid ejecting apparatus maintenance method according to Idea 8, wherein the second maintenance operation is performed in a printing operation of ejecting the liquid onto the medium from the liquid ejecting unit for printing.

When the liquid ejecting unit in which the foreign matters have adhered to the nozzle surface performs the printing operation, ejection failure that the liquid cannot be appropriately ejected through the nozzles and contaminant of the medium, which is caused by contact between the foreign matters and the medium, occur in some cases. For avoiding these problems, the second maintenance operation is performed in the printing operation on which the foreign matters adhering to the nozzles are likely to give influences. Therefore, the foreign matters adhering to the nozzle surface can be efficiently removed.

Idea 10

The liquid ejecting apparatus maintenance method according to Idea 8 or Idea 9, wherein the liquid ejecting apparatus includes a cleaning mechanism that cleans the medium support portion, and the method includes cleaning the medium support portion by the cleaning mechanism after the second cleaning member is made contact with the medium support portion.

This method can provide the same effects as those provided by the above-described liquid ejecting apparatus.

The entire disclosure of Japanese Patent Application No. 2018-040463, filed Mar. 7, 2018 is expressly incorporated by reference herein.

What is claimed is:

1. A liquid ejecting apparatus comprising:

a medium support portion that has a medium support surface for supporting a medium;

a liquid ejecting unit that ejects liquid onto the medium supported on the medium support surface through a plurality of nozzles arranged in a nozzle surface;

a first cleaning member that wipes the nozzle surface by moving relative to the liquid ejecting unit in a direction along the nozzle surface in a first maintenance operation of discharging the liquid through the nozzles for maintenance of the liquid ejecting unit;

a second cleaning member that removes foreign matters which have adhered to the nozzle surface by moving relative to the liquid ejecting unit in the direction along the nozzle surface in a second maintenance operation of removing the foreign matters; and a guiding portion configured to maintain a distance between the nozzle surface and the second cleaning member in the second maintenance operation, the guiding portion being provided so as to be movable integrally with the second cleaning member, and moving relative to the liquid ejecting unit in a state of making contact with the liquid ejecting unit.

2. The liquid ejecting apparatus according to claim 1, wherein in the second maintenance operation, the second cleaning member moves relative to the liquid ejecting unit in the direction along the nozzle surface at a position at which a distance to the nozzle surface in a normal line direction of the nozzle surface is smaller than a distance between the nozzle surface and the medium support surface in the normal line direction and the second cleaning member does not make contact with the nozzle surface.

3. The liquid ejecting apparatus according to claim 1, wherein the second cleaning member is formed by an absorbent capable of absorbing the liquid.

4. The liquid ejecting apparatus according to claim 1, wherein the liquid ejecting unit ejects the liquid while moving in a scanning direction relative to the medium supported on the medium support surface, and the second cleaning member is arranged at a position adjacent to the medium support portion in the scanning direction.

5. The liquid ejecting apparatus according to claim 1, further comprising: a cleaning mechanism that cleans the medium support portion, wherein the second cleaning member is provided so as to make contact with the medium support portion.

6. The liquid ejecting apparatus according to claim 1, further comprising:

a nozzle inspection unit that inspects an ejection state of the liquid through the nozzles; and a controller that causes the second maintenance operation to be executed when it is estimated that the foreign matters adhere to the nozzle surface based on an inspection result by the nozzle inspection unit in a printing operation of ejecting the liquid onto the medium from the liquid ejecting unit for printing.

7. A liquid ejecting apparatus maintenance method for maintaining a liquid ejecting apparatus including:

a medium support portion that has a medium support surface for supporting a medium;

a liquid ejecting unit that ejects liquid onto the medium supported on the medium support surface through a plurality of nozzles arranged in a nozzle surface;

a first cleaning member; and a second cleaning member, the method comprising:

wiping the nozzle surface by moving the first cleaning member relative to the liquid ejecting unit in a direction along the nozzle surface in a first maintenance operation of discharging the liquid through the nozzles for maintenance of the liquid ejecting unit, and removing foreign matters which have adhered to the nozzle surface by moving the second cleaning member relative to the liquid ejecting unit in the direction along the nozzle surface in a second maintenance operation of removing the foreign matters, the first cleaning member moving independently from the second cleaning member.

8. The liquid ejecting apparatus maintenance method according to claim 7, wherein the second maintenance operation is performed in a printing operation of the liquid ejecting unit ejecting the liquid onto the medium located in a printing area, and wherein the second maintenance operation is performed in a state where the medium on the medium support surface is located in the printing area.

9. The liquid ejecting apparatus maintenance method according to claim 7, wherein the liquid ejecting apparatus includes a cleaning mechanism that cleans the medium support portion wherein the second cleaning member includes a base end supported and a front end in the second maintenance operation is closer to the nozzle surface than the base end, and the method includes cleaning the medium support portion by the cleaning mechanism after the front end of the second cleaning member is contact with the medium support portion.

10. A liquid ejecting apparatus comprising:

a medium support portion that has a medium support surface for supporting a medium;

a liquid ejecting unit that ejects liquid onto the medium supported on the medium support surface through a plurality of nozzles arranged in a nozzle surface;

a first cleaning member that wipes the nozzle surface by moving relative to the liquid ejecting unit in a direction along the nozzle surface in a first maintenance operation of discharging the liquid through the nozzles for maintenance of the liquid ejecting unit; and a second cleaning member that removes foreign matters which have adhered to the nozzle surface by moving relative to the liquid ejecting unit in the direction along the nozzle surface in a second maintenance operation of removing the foreign matters, the second cleaning member moving independently from the first cleaning member.

11. The liquid ejecting apparatus according to claim 10, wherein in the second maintenance operation, the second cleaning member moves relative to the liquid ejecting unit in the direction along the nozzle surface at a position at which a distance to the nozzle surface in a normal line direction of the nozzle surface is smaller than a distance between the nozzle surface and the medium support surface in the normal line direction and the second cleaning member does not make contact with the nozzle surface.

12. The liquid ejecting apparatus according to claim 11, wherein in the second maintenance operation, the second cleaning member makes contact with the foreign matters which have adhered to the nozzle surface.

13. The liquid ejecting apparatus according to claim 12, wherein the plurality of nozzles forms a nozzle row, wherein in the second maintenance operation, the second cleaning member moves relative to the liquid ejecting unit in a direction intersecting a row direction along the nozzle row.

14. The liquid ejecting apparatus according to claim 10, further comprising:

a cleaning mechanism that cleans the medium support portion; and a second cleaning member supporting portion that supports the second cleaning member, wherein the medium support portion includes a non-supporting portion that does not support the medium, wherein the second cleaning member supporting portion is configured to make the second cleaning member contact with the non-supporting portion.

15. The liquid ejecting apparatus according to claim 10, further comprising:

a cleaning mechanism that cleans the medium support portion; and a second cleaning member supporting portion that supports a base end of the second cleaning member so as to take a cleaning position of a front end of the second cleaning member in the second maintenance operation and a contact position where the front end contacts the medium support portion, the front end in the second maintenance operation being closer to the nozzle surface than the base end, and the cleaning position of the front end being located higher than the contact position of the front end.

* * * * *